US010589543B2

(12) United States Patent
Sawamura et al.

(10) Patent No.: US 10,589,543 B2
(45) Date of Patent: Mar. 17, 2020

(54) IMAGE RECORDING APPARATUS AND IMAGE RECORDING METHOD

(71) Applicant: RICOH COMPANY, LTD., Tokyo (JP)

(72) Inventors: Ichiro Sawamura, Shizuoka (JP); Yoshihiko Hotta, Shizuoka (JP); Kazuyuki Uetake, Shizuoka (JP); Takahiro Furukawa, Kanagawa (JP); Tomomi Ishimi, Shizuoka (JP); Yasuroh Yokota, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/050,198

(22) Filed: Jul. 31, 2018

(65) Prior Publication Data

US 2018/0333964 A1 Nov. 22, 2018

Related U.S. Application Data

(63) Continuation of application No. PCT/JP2017/004127, filed on Feb. 3, 2017.

(30) Foreign Application Priority Data

Feb. 5, 2016 (JP) ..... 2016-021355
Feb. 3, 2017 (JP) ..... 2017-018476

(51) Int. Cl.
*B41J 2/447* (2006.01)
*B41J 2/365* (2006.01)
(Continued)

(52) U.S. Cl.
CPC ..... *B41J 2/365* (2013.01); *B41J 2/3551* (2013.01); *B41J 2/475* (2013.01); *B41J 2/447* (2013.01); *B41J 2/46* (2013.01)

(58) Field of Classification Search
CPC ... B41J 2/435; B41J 2/442; B41J 2/447; B41J 2/45; B41J 2/451; B41J 2/455; B41J 2/46;
(Continued)

(56) References Cited

U.S. PATENT DOCUMENTS 5,966,394 A * 10/1999 Spurr ..... H01S 5/042 372/29.015
6,683,640 B1 1/2004 Sasaki et al.
(Continued)

FOREIGN PATENT DOCUMENTS

CN 102189864 A 9/2011
CN 103204002 A 7/2013
(Continued)

OTHER PUBLICATIONS

International Search Report dated Apr. 11, 2017 in PCT/JP2017/004127 filed on Feb. 3, 2017.
(Continued)

*Primary Examiner* — Scott A Richmond
(74) *Attorney, Agent, or Firm* — Xsensus LLP

(57) ABSTRACT

An image recording apparatus includes a plurality of laser emission parts disposed side by side in a predetermined direction for emitting laser light; an optical system configured to collect a plurality of beams of laser light emitted by the laser emission parts onto the recording target moving relative to the laser emission parts in a direction crossing the predetermined direction; and an output control unit configured to perform control such that energy of laser light emitted from an outermost end laser emission part of the laser emission parts is greater than energy of laser light emitted from a center laser emission part, the outermost end laser emission part emitting laser light to be transmitted through vicinity of an end portion of the optical system, the
(Continued)

center laser emission part emitting laser light to be transmitted through a portion other than vicinity of the end portion of the optical system.

20 Claims, 11 Drawing Sheets

(51) Int. Cl.
*B41J 2/475* (2006.01)
*B41J 2/355* (2006.01)
*B41J 2/46* (2006.01)

(58) Field of Classification Search
CPC ..... B41J 2/465; B41J 2/47; B41J 2/471; B41J 2/473; B41J 2/475; B41J 2/36; B41J 2/362
See application file for complete search history.

(56) References Cited

U.S. PATENT DOCUMENTS

| | | | | |
|---|---|---|---|---|
| 8,598,074 | B2 | 12/2013 | Kawahara et al. | |
| 8,723,909 | B2 | 5/2014 | Asai et al. | |
| 9,757,956 | B2 | 9/2017 | Ishimi et al. | |
| 2002/0015088 | A1* | 2/2002 | Inoue | B41J 2/45 347/238 |
| 2002/0191069 | A1 | 12/2002 | Oka | |
| 2010/0047701 | A1* | 2/2010 | Stevenson | G02B 5/201 430/30 |
| 2011/0090299 | A1 | 4/2011 | Asai et al. | |
| 2011/0102537 | A1* | 5/2011 | Griffin | B41J 2/45 347/237 |
| 2011/0207603 | A1 | 8/2011 | Kawahara et al. | |
| 2013/0141512 | A1 | 6/2013 | Asai et al. | |
| 2016/0279968 | A1 | 9/2016 | Ishimi et al. | |

FOREIGN PATENT DOCUMENTS

| | | |
|---|---|---|
| CN | 105050819 A | 11/2015 |
| JP | 58-148777 | 9/1983 |
| JP | 02-192964 | 7/1990 |
| JP | 04-168057 | 6/1992 |
| JP | 06-234227 | 8/1994 |
| JP | 07-052436 | 2/1995 |
| JP | 07-125282 | 5/1995 |
| JP | 11-070699 | 3/1999 |
| JP | 2000-033719 | 2/2000 |
| JP | 2001-191566 | 7/2001 |
| JP | 2002-361911 | 12/2002 |
| JP | 2006-065214 | 3/2006 |
| JP | 2007-030357 | 2/2007 |
| JP | 2010-052350 | 3/2010 |
| JP | 2011-104994 | 6/2011 |
| JP | 2015-168071 | 9/2015 |

OTHER PUBLICATIONS

Written Opinion dated Apr. 11, 2017 in PCT/JP2017/004127 filed on Feb. 3, 2017.
Chinese Office Action dated May 28, 2019, in corresponding Chinese Application No. 201780009573.2, 25 pages (with English Translation).

* cited by examiner

IMAGE RECORDING APPARATUS AND IMAGE RECORDING METHOD

CROSS-REFERENCE TO RELATED APPLICATIONS

This application is a continuation of PCT international application Ser. No. PCT/JP2017/004127 filed on Feb. 3, 2017 which designates the United States, incorporated herein by reference, and which claims the benefit of priority from Japanese Patent Applications No. 2016-021355, filed on Feb. 5, 2016 and Japanese Patent Applications No. 2017-018476, filed on Feb. 3, 2017, incorporated herein by reference.

BACKGROUND OF THE INVENTION

1. Field of the Invention

Embodiments relate to an image recording apparatus and an image recording method.

2. Description of the Related Art

Image recording apparatuses have been known, which record a visible image on a recording target by irradiating the recording target with laser light to heat the recording target.

An example of the image recording apparatuses is described in Patent Literature 1, which provides an image recording apparatus including a laser irradiation device such as a laser array in which a plurality of semiconductor lasers serving as laser light-emitting elements are arranged in an array for irradiating positions different from each other in a predetermined direction with laser light emitted from the semiconductor lasers. The image recording apparatus described in Japanese Patent Application Laid-open No. 2010-52350 irradiates a recording target moving relative to the laser irradiation device in a direction different from the predetermined direction with laser light to record a visible image on the recording target.

Unfortunately, in the image recording apparatus described in Japanese Patent Application Laid-open No. 2010-52350, the density of an image recorded with laser light emitted from the semiconductor laser disposed at an end of the laser irradiation device is lower than the density of other images.

In view of the foregoing, there is a need to provide an image recording apparatus and an image recording method capable of suppressing reduction in image density of an image recorded with laser light emitted from an end laser emission part.

SUMMARY OF THE INVENTION

According to an embodiment, the present invention provides an image recording apparatus configured to irradiate a recording target with laser light to record an image. The image recording apparatus includes a plurality of laser emission parts, an optical system, and an output control unit. The plurality of laser emission parts are disposed side by side in a predetermined direction and are configured to emit laser light. The optical system is configured to collect a plurality of beams of laser light emitted by the laser emission parts onto the recording target moving relative to the laser emission parts in a direction crossing the predetermined direction. And, the output control unit is configured to perform control such that energy of laser light emitted from an outermost end laser emission part of the laser emission parts is greater than energy of laser light emitted from a center laser emission part, the outermost end laser emission part emitting laser light to be transmitted through vicinity of an end portion of the optical system, the center laser emission part emitting laser light to be transmitted through a portion other than vicinity of the end portion of the optical system.

BRIEF DESCRIPTION OF THE DRAWINGS

FIG. 3-1 is an enlarged schematic view of an optical fiber;

FIG. 3-2 is an enlarged view of the vicinity of an array head;

FIG. 4-1 is a diagram illustrating an example of the disposition of array heads;

FIG. 4-2 is a diagram illustrating an example of the disposition of array heads;

FIG. 4-3 is a diagram illustrating an example of the disposition of array heads;

FIG. 4-4 is a diagram illustrating an example of the disposition of array heads;

FIG. 4-5 is a diagram illustrating an example of the disposition of array heads;

FIG. 5 is a block diagram illustrating part of an electric circuit in the image recording system;

FIG. 8-1 is a diagram illustrating output of each laser light-emitting element in Example 1 and the distance in the X-axis direction between adjacent array heads;

FIG. 8-2 is a diagram illustrating output of each laser light-emitting element in Example 2 and the distance in the X-axis direction between adjacent array heads;

FIG. 8-3 is a diagram illustrating output of each laser light-emitting element in Example 3 and the distance in the X-axis direction between adjacent array heads;

FIG. 8-4 is a diagram illustrating output of each laser light-emitting element in Example 4 and the distance in the X-axis direction between adjacent array heads;

FIG. 8-5 is a diagram illustrating output of each laser light-emitting element in Comparative Example and the distance in the X-axis direction between adjacent array heads;

FIG. 9-1 is a diagram illustrating an example of the image recording system in a first modification; and FIG. 9-2 is a diagram illustrating an example of the image recording system in the first modification.

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
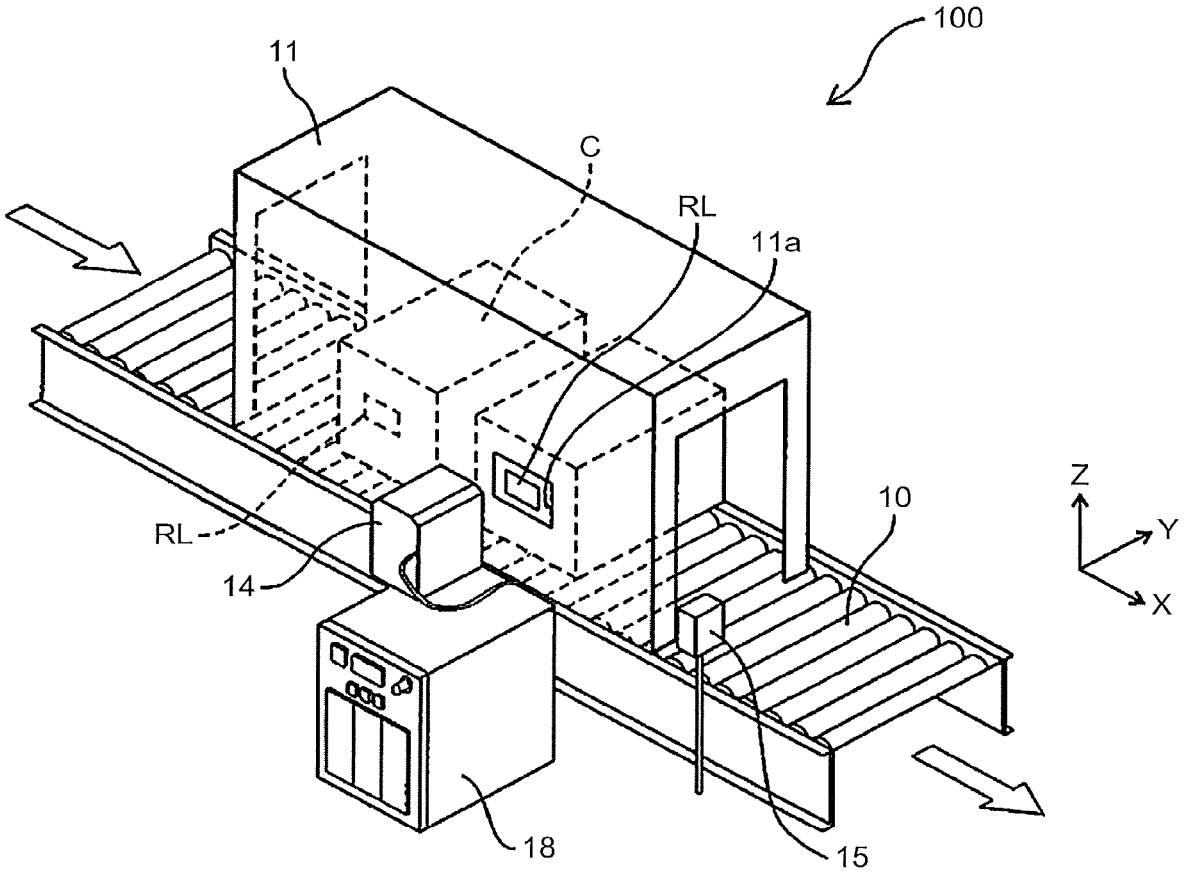
FIG. 1 is a schematic perspective view of an image recording system according to embodiments.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Embodiments of an image recording apparatus and an image recording method employing the present invention will be described below. The image recording apparatus irradiates a recording target with laser light to record an image.

The image is any information that can be visually recognized and can be selected as appropriate according to the purpose. Examples of the image include characters, symbols, lines, graphics, solid images and combinations thereof, and two-dimensional codes such as barcodes and QR codes (registered trademark).

The recording target may be anything recordable with a laser and can be selected as appropriate according to the purpose. The recording target may be anything that can absorb and convert light into heat to form an image, for example, including metal engraving. Examples of the recording target include a thermal recording medium and a structure including a thermal recording part.

The thermal recording medium has a support and an image recording layer on the support and further has other layers, if necessary. Each of these layers may be a single layer structure or a multilayer structure or may be formed on the other surface of the support.

Image Recording Layer

The image recording layer contains leuco dye and a developer and further contains other components, if necessary.

The leuco dye is not limited to a particular dye and can be selected as appropriate from those commonly used in thermal recording materials according to the purpose. For example, leuco compounds, such as triphenylmethane-based, fluoran-based, phenothiazine-based, auramine-based, spiropyran-based, and indolinophthalide-based dyes, are preferably used as the leuco dye.

For example, a variety of electron-accepting compounds that color the leuco dye when coming into contact therewith or an oxidant can be applied as the developer.

Examples of the other components include binder resin, photothermal conversion material, thermally fusible substance, antioxidant, photostabilizer, surfactant, slip additive, and filler.

Support

The support is not limited to particular shape, structure, size, etc. and can be selected as appropriate according to the purpose. An example of the shape is a flat-plate shape. The structure may be a single layer structure or a multilayer structure. The size can be selected as appropriate according to, for example, the size of the thermal recording medium.

Other Layers

Examples of the other layers include photothermal conversion layer, protective layer, underlayer, ultraviolet absorbing layer, oxygen blocking layer, intermediate layer, back layer, adhesive layer, and tacky layer.

The thermal recording medium can be processed into a desired shape according to the application. Examples of the shape include card, tag, label, sheet, and roll shapes. Examples of the medium processed into the card shape include prepaid card, discount card, and credit card. The medium processed into a tag size smaller than the card size can be used for, for example, price tags. The medium processed into a tag size larger than the card size can be used for, for example, process management, shipment instructions, and tickets. The medium processed into a label shape that can be affixed is processed into a variety of sizes and affixed to a carriage, a case, a box, a container and the like repeatedly used for process management, product management, and other purposes. The medium processed into a sheet size larger than the card size has a large area for recording an image and therefore can be used for general documents, instructions for process management, and other purposes.

Examples of the thermal recording part of the structure are a section where a label-shaped thermal recording medium is affixed on a surface of the structure and a section where a thermal recording material is applied on a surface of the structure. The structure having the thermal recording part may be any structure that has a thermal recording part on a surface of the structure and can be selected as appropriate according to the purpose. Examples of the structure having the thermal recording part include a variety of commercial products, such as plastic bags, PET bottles, and cans, carrying cases such as cardboard boxes and containers, workpieces, and industrial products.

An image recording apparatus that records an image on a structure having a thermal recording part as the recording target, specifically, a container C for transportation to which a thermal recording label is affixed as a recording target will be described below by way of illustration.

FIG. 1 is a schematic perspective view of an image recording system 100 serving as an image recording apparatus according to embodiments. In the following description, the conveyance direction of a container C for transportation is referred to as X-axis direction, the vertical direction is referred to as Z-axis direction, and the direction orthogonal to both of the conveyance direction and the vertical direction is referred to as Y-axis direction.

The image recording system 100 irradiates a thermal recording label RL affixed to a container C for transportation as a recording target with laser light to record an image, as will be detailed later.

As illustrated in FIG. 1, the image recording system 100 includes a conveyor device 10 serving as a recording target conveyance unit, a recording device 14, a system control device 18, a reading device 15, and a shielding cover 11.

The recording device 14 irradiates a recording target with laser light to record an image as a visible image on the recording target. The recording device 14 is arranged on the −Y side of the conveyor device 10, that is, the −Y side of the conveyance path.

The shielding cover 11 provides a shield from laser light emitted from the recording device 14 to reduce diffusion of laser light and has a surface with a black, anodic oxide coating. A part of the shielding cover 11 that is opposed to the recording device 14 has an opening 11*a* for allowing laser light to pass through. Although the conveyor device 10 is a roller conveyor in the present embodiment, it may be a belt conveyor.

The system control device 18 is connected with the conveyor device 10, the recording device 14, and the reading device 15 for controlling the entire image recording system 100. As will be described later, the reading device 15 scans a code image such as a two-dimensional code such as a barcode and a QR code recorded on a recording target. The system control device 18 checks whether an image is correctly recorded, based on information scanned by the reading device 15.

The thermal recording label RL affixed to the container C will now be described.

The thermal recording label RL is a thermal recording medium on which an image is recorded by heat changing a color tone. In the present embodiment, a thermal recording medium subjected to one-time image recording is used as a thermal recording label RL. However, a thermo-reversible recording medium recordable multiple times may be used as a thermal recording label RL.

The thermal recording medium used as a thermal recording label RL in the present embodiment includes a material (photothermal conversion material) that absorbs and converts laser light into heat and a material that develops a change in hue, reflectivity, etc. by heat.

The photothermal conversion material can be classified mainly into inorganic material and organic material. Examples of the inorganic material include particles of at least one of carbon black, metal borides, and metal oxides of Ge, Bi, In, Te, Se, Cr, etc. The inorganic material is preferably a material having high absorption of light in the near-infrared wavelength region and low absorption of light in the visible light wavelength region. The metal borides and the metal oxides are preferred. The inorganic material is preferably, for example, at least one selected from hexaborides, tungsten oxide compounds, antimony tin oxide (ATO), indium tin oxide (ITO), and zinc antimonate.

Examples of the hexaborides include $LaB_6$, $CeB_6$, $PrB_6$, $NdB_6$, $GdB_6$, $TbB_6$, $DyB_6$, $HoB_6$, $YB_6$, $SmB_6$, $EuB_6$, $ErB_6$, $TmB_6$, $YbB_6$, $LuB_6$, $SrB_6$, $CaB_6$, and $(La, Ce)B_6$.

Examples of the tungsten oxide compounds include fine particles of tungsten oxide of general formula: WyOz (where W is tungsten, O is oxygen, $2.2 \leq z/y \leq 2.999$) as described in WO2005/037932 and Japanese Patent Application Laid-open No. 2005-187323, and fine particles of composite tungsten oxide of general formula: MxWyOz (where M is one or more elements selected from H, He, alkali metals, alkaline-earth metals, rare-earth elements, Mg, Zr, Cr, Mn, Fe, Ru, Co, Rh, Ir, Ni, Pd, Pt, Cu, Ag, Au, Zn, Cd, Al, Ga, In, Tl, Si, Ge, Sn, Pb, Sb, B, F, P, S, Se, Br, Te, Ti, Nb, V, Mo, Ta, Re, Be, Hf, Os, Bi, and I, W is tungsten, O is oxygen, $0.001 \leq x/y \leq 1$, $2.2 \leq z/y \leq 3.0$).

Among these, cesium-containing tungsten oxide is particularly preferred as the tungsten oxide compound in terms of high absorption in the near-infrared region and low absorption in the visible light region.

Among the antimony tin oxide (ATO), the indium tin oxide (ITO), and the zinc antimonate, ITO is particularly preferred as the tungsten oxide compound in terms of high absorption in the near-infrared region and low absorption in the visible light region. These are formed in the form of a layer by vacuum vapor deposition or bonding a particulate material with resin.

A variety of dyes can be used as appropriate as the organic material depending on the light wavelengths to be absorbed. When a semiconductor laser is used as a light source, near-infrared absorbing pigment having an absorption peak in the vicinity of 600 nm to 1200 nm is used. Specifically, examples of the organic material include cyanine pigment, quinone-based pigment, quinoline derivatives of indonaphthol, phenylenediamine-based nickel complex, and phthalocyanine-based pigment.

The photothermal conversion material may be used singly or in combination of two or more. The photothermal conversion material may be provided in the image recording layer or may be provided outside the image recording layer. When the photothermal conversion material is provided outside the image recording layer, a photothermal conversion layer is preferably provided adjacent to a thermo-reversible recording medium. The photothermal conversion layer at least contains the photothermal conversion material and a binder resin.

The material that develops a change in hue, reflectivity, etc. by heat may be, for example, a known material that includes a combination of an electron-donating dye precursor and an electron-accepting developer for use in conventional thermal paper. The material that develops a change in hue, reflectivity, etc. by heat includes a material that develops a change, such as a complex reaction of heat and light, for example, a color-changing reaction involved with solid phase polymerization by heating a diacetylene-based compound and ultraviolet light radiation.

Figure 2:
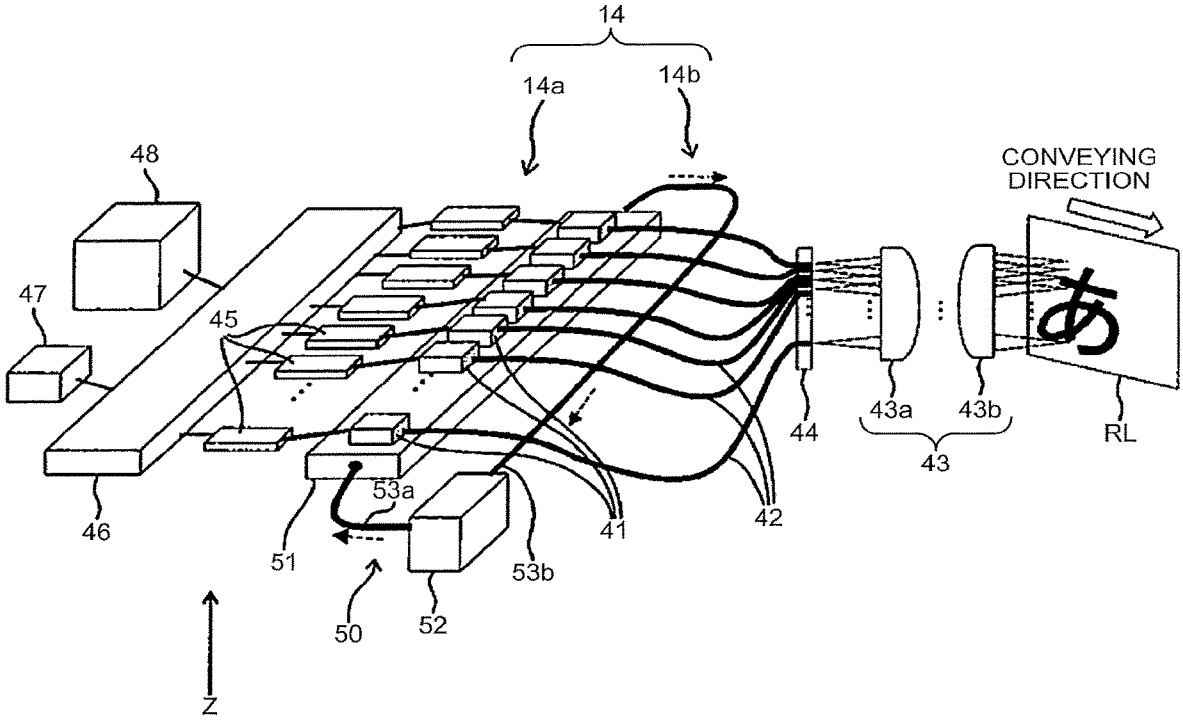
FIG. 2 is a schematic perspective view of a configuration of a recording device.

FIG. 2 is a schematic perspective view of a configuration of the recording device 14.

In the present embodiment, a fiber array recording device is used as the recording device 14. The fiber array recording device records an image using a fiber array in which the laser emission parts of a plurality of optical fibers are arranged in an array in the main-scanning direction (the Z-axis direction) orthogonal to the sub-scanning direction (the X-axis direction) that is the moving direction of the container C serving as a recording target. The fiber array recording device irradiates a recording target with laser light emitted from laser light-emitting elements through the fiber array to record an image including units of drawing. Specifically, the recording device 14 includes a laser array unit 14*a*, a fiber array unit 14*b*, and an optical unit 43.

The laser array unit 14*a* includes a plurality of laser light-emitting elements 41 arranged in an array, a cooling unit 50 for cooling the laser light-emitting elements 41, a plurality of drivers 45 provided corresponding to the laser light-emitting elements 41 for driving the corresponding laser light-emitting elements 41, and a controller 46 for controlling a plurality of drivers 45. The controller 46 is connected with a power supply 48 for supplying electricity to the laser light-emitting elements 41 and an image information output unit 47 such as a personal computer for outputting image information.

The laser light-emitting element 41 can be selected as appropriate according to the purpose and, for example, a semiconductor laser, a solid-state laser, a pigment laser, or the like can be used. Among those, a semiconductor laser is preferably used as the laser light-emitting element 41 in terms of wide wavelength selectivity, compactness which allows size reduction of the device, and low costs.

The wavelength of the laser light emitted by the laser light-emitting element 41 is not limited and can be selected as appropriate according to the purpose. The wavelength of the laser light is preferably 700 nm to 2000 nm, more preferably 780 nm to 1600 nm.

In the laser light-emitting element 41 serving as an emission unit, the applied energy is not entirely converted into laser light. In general, the laser light-emitting element 41 generate heat, as a result of energy not converted into laser light being converted into heat. Thus, the laser light-emitting element 41 is cooled by the cooling unit 50 serving as a cooler. The recording device 14 of the present embodiment uses the fiber array unit 14*b* to allow the laser light-emitting elements 41 to be spaced apart from each other. This arrangement can reduce the effect of heat from the adjacent laser light-emitting elements 41 to enable efficient cooling of the laser light-emitting elements 41, thereby avoiding temperature increase and variations of the laser light-emitting elements 41, reducing output variations of laser light, and alleviating density unevenness and white spots. The output of laser light is the average output measured by a power meter. There are two methods for controlling the output of laser light: controlling the peak power and controlling the light emission ratio (duty: laser light emission time/cycle time) of a pulse.

The cooling unit 50 is a liquid cooling system that cools the laser light-emitting elements 41 by circulating a coolant and includes a heat receiver 51 for allowing the coolant to receive heat from each laser light-emitting element 41 and a heat dissipator 52 for dissipating heat of the coolant. The heat receiver 51 and the heat dissipator 52 are connected to each other through cooling pipes 53*a* and 53*b*. The heat receiver 51 is provided with a cooling tube formed of a high conductive material for allowing the coolant to flow in a case formed of a high conductive material. A plurality of laser light-emitting elements 41 are arranged in an array on the heat receiver 51.

The heat dissipator 52 includes a radiator and a pump for circulating the coolant. The coolant ejected by the pump in the heat dissipator 52 passes through the cooling pipe 53*a* to flow into the heat receiver 51. The coolant then removes heat of the laser light-emitting elements 41 arrayed on the heat receiver 51 while moving in the cooling tube in the heat receiver 51 to cool the laser light-emitting elements 41. The coolant with temperature increased by heat removed from the laser light-emitting elements 41 flows out of the heat receiver 51, moves through the cooling pipe 53*b*, and flows into the radiator in the heat dissipator 52 to be cooled by the radiator. The coolant cooled by the radiator is ejected again by the pump to the heat receiver 51.

The fiber array unit 14*b* includes a plurality of optical fibers 42 provided corresponding to the laser light-emitting elements 41 and an array head 44 holding the vicinity of laser emission parts 42*a* (see FIG. 3-2) of the optical fibers 42 in the form of an array in the vertical direction (the Z-axis direction). The laser light entrance part of each optical fiber 42 is attached to the laser light emission face of the corresponding laser light-emitting element 41. The Z-axis direction is an example of the predetermined direction.

Figures 1, 3:
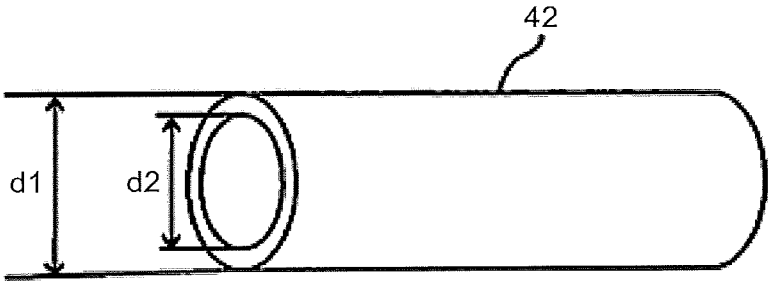
Figures 2, 3:
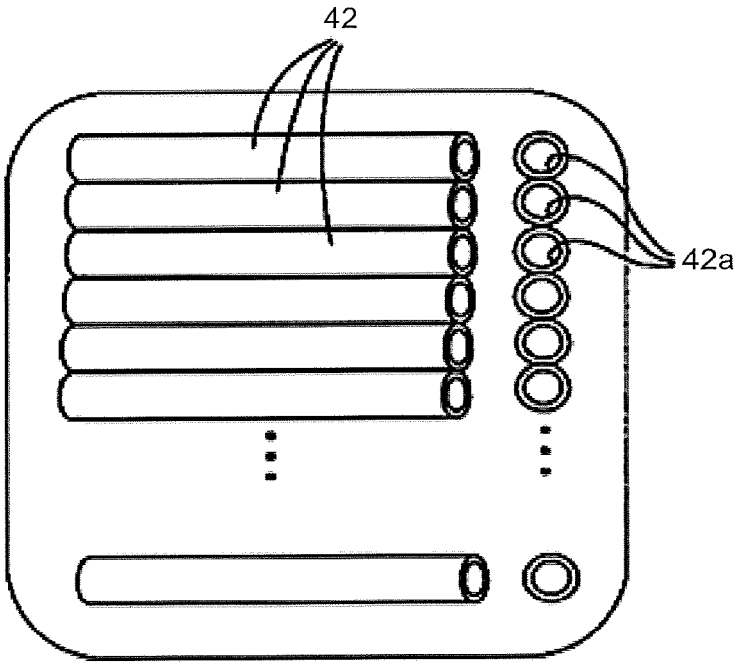

FIG. 3-1 is an enlarged schematic diagram of the optical fiber 42. FIG. 3-2 is an enlarged view of the vicinity of the array head 44.

The optical fiber 42 is an optical waveguide of laser light emitted from the laser light-emitting element 41. The optical fiber 42 is not limited to particular shape, size (diameter), material, structure, etc. and can be selected as appropriate according to the purpose.

The size (diameter d1) of the optical fiber 42 is preferably not less than 15 μm to not more than 1000 μm. The diameter d1 of the optical fiber 42 is advantageously not less than 15 μm to not more than 1000 μm in terms of the fineness of an image. The optical fiber 42 used in the present embodiment has a diameter of 125 μm.

The material of the optical fiber 42 is not limited and can be selected as appropriate according to the purpose. Examples of the material include glass, resin, and quartz.

A preferable structure of the optical fiber 42 includes a core at the center to allow laser light to pass through and a cladding layer provided on the outer periphery of the core.

The diameter d2 of the core is not limited and can be selected as appropriate according to the purpose. The diameter d2 is preferably not less than 10 μm to not more than 500 μm. In the present embodiment, an optical fiber having a core diameter d2 of 105 μm is used. The material of the core is not limited and can be selected as appropriate according to the purpose, and examples include glass doped with germanium or phosphorus.

The average thickness of the cladding layer is not limited and can be selected as appropriate according to the purpose. The average thickness is preferably not less than 10 μm to not more than 250 μm. The material of the cladding layer is not limited and can be selected as appropriate according to the purpose. Examples of the material of the cladding layer include glass doped with boron or fluorine.

As illustrated in FIG. 3-2, the vicinity of the laser emission parts 42*a* of a plurality of optical fibers 42 is held in an array by the array head 44 such that the pitch of the laser emission part 42*a* of each optical fiber 42 is 127 μm. In the recording device 14, the pitch of the laser emission part 42*a* is 127 μm such that an image with a resolution of 200 dpi can be recorded.

Supposing that all the optical fibers 42 are held by a single array head 44, the array head 44 is elongated and easily deformed. As a result, it is difficult to keep the linearity beam arrangement and the evenness of beam pitches with a single array head 44. For this reason, the array head 44 is configured to hold 100 to 200 optical fibers 42. Based on this, in the recording device 14, it is preferable that a plurality of array heads 44 each holding 100 to 200 optical fibers 42 are disposed side by side in the Z-axis direction orthogonal to the conveyance direction of the container C. In the present embodiment, 200 array heads 44 are disposed side by side in the Z-axis direction.

Figures 1, 4:
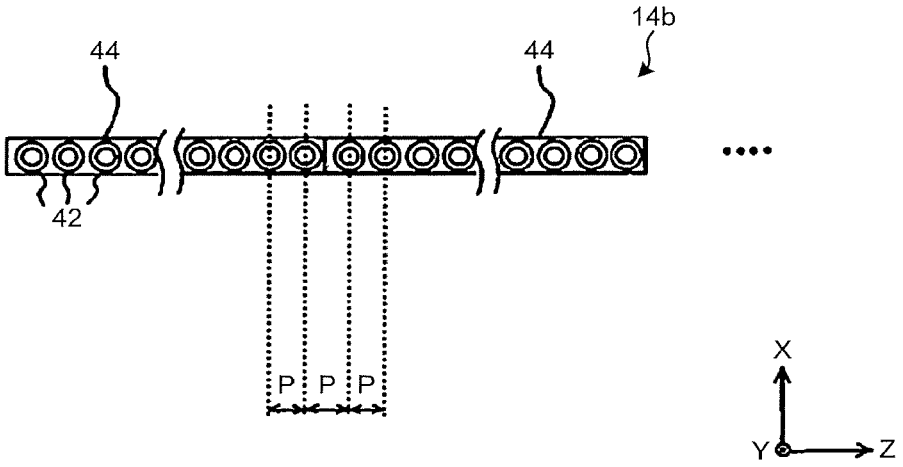
Figures 2, 4:
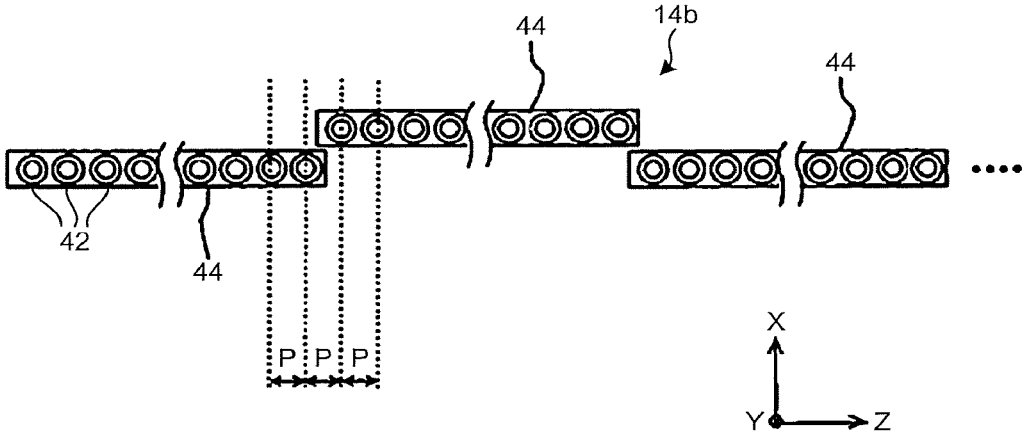
Figures 3, 4:
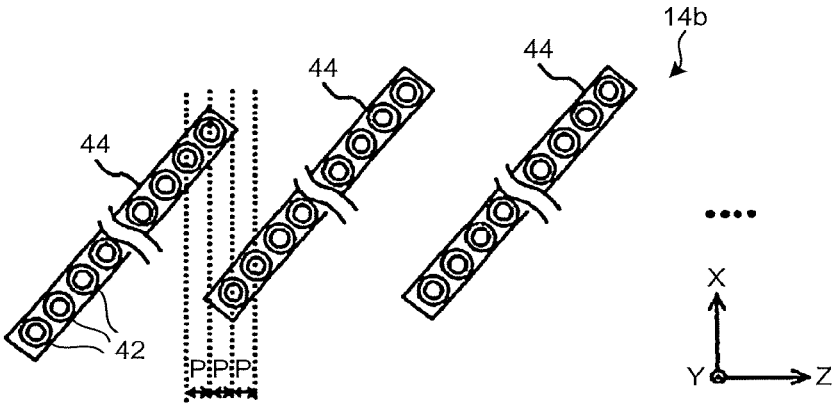
Figure 4:
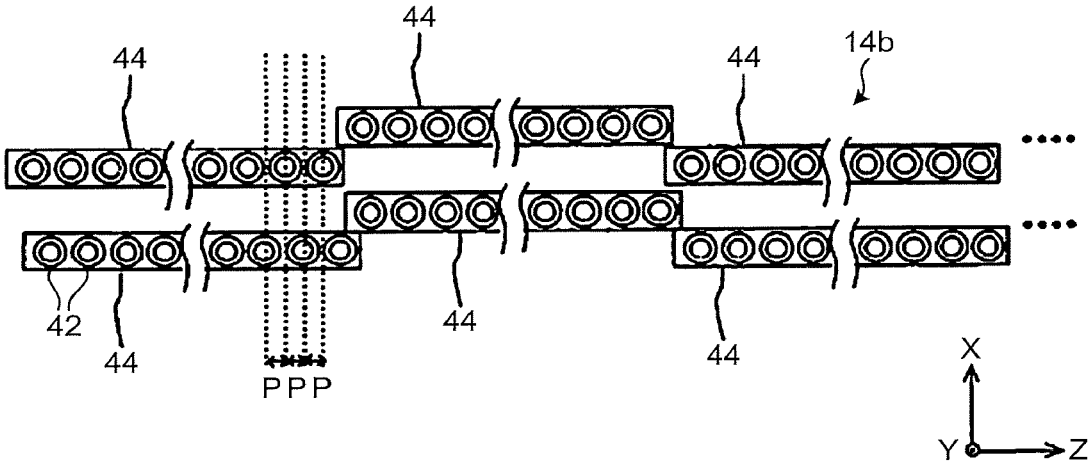
Figures 4, 5:
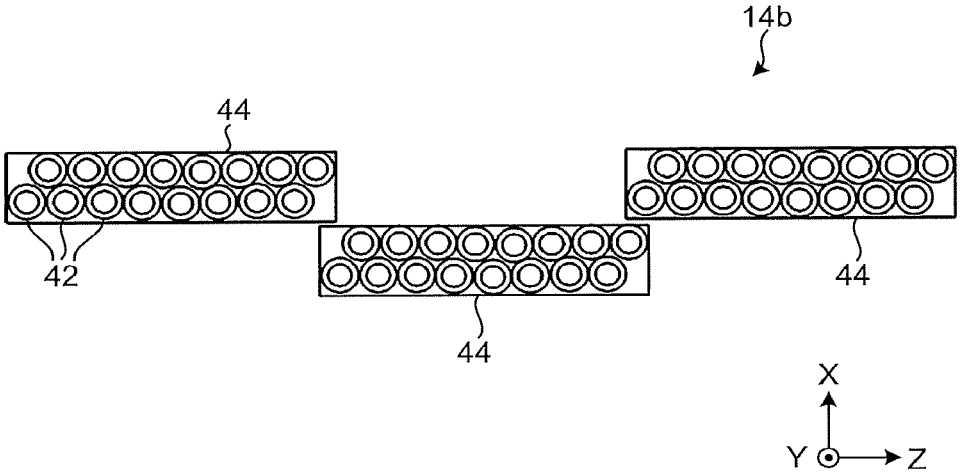
Figure 5:
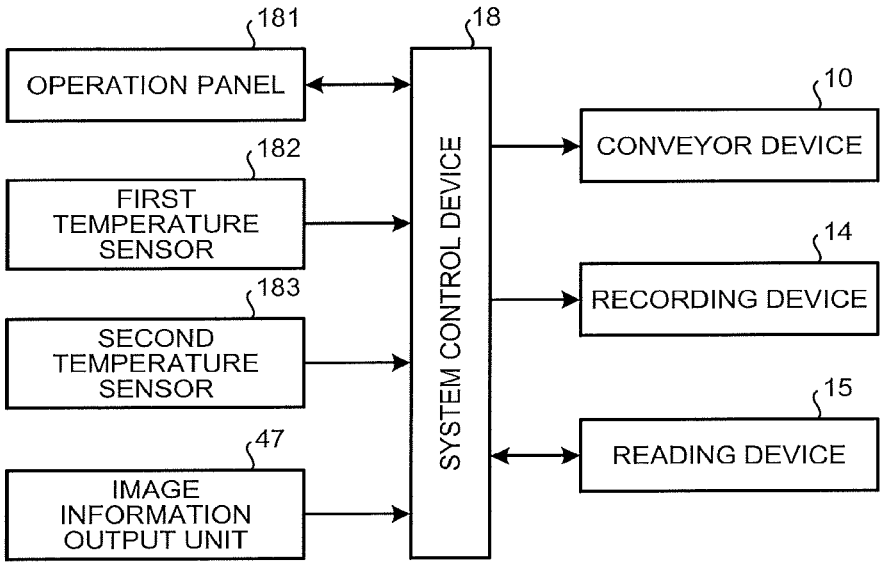

FIG. 4-1 to FIG. 4-5 are diagrams illustrating examples of the disposition of the array heads 44.

FIG. 4-1 is an example in which a plurality of array heads 44 of the fiber array unit 14*b* in the recording device 14 are arranged in an array in the Z-axis direction. FIG. 4-2 is an example in which a plurality of array heads 44 of the fiber array unit 14*b* in the recording device 14 are arranged in a staggered pattern.

The arrangement of a plurality of array heads 44 is preferably in a staggered pattern as illustrated in FIG. 4-2, rather than the linear arrangement in the Z-axis direction as illustrated in FIG. 4-1, in terms of easiness of assembly.

FIG. 4-3 is an example in which a plurality of array heads 44 of the fiber array unit 14*b* in the recording device 14 are arranged at an angle in the X-axis direction. Arranging a plurality of array heads 44 as illustrated in FIG. 4-3 can reduce the pitch P of the optical fiber 42 in the Z-axis direction, compared with the arrangements illustrated in FIG. 4-1 and FIG. 4-2, thereby achieving a higher resolution.

FIG. 4-4 illustrates an example of the arrangement in which two array head groups, each having a plurality of array heads 44 in a staggered pattern of the fiber array unit 14*b* in the recording device 14, are arranged in the sub-scanning direction (the X-axis direction), and one of the array head groups is shifted from the other array head group by half the array pitch of the optical fiber 42 in the array head 44 in the main-scanning direction (the Z-axis direction). Arranging a plurality of array heads 44 as illustrated in FIG. 4-4 can also reduce the pitch P of the optical fiber 42 in the Z-axis direction, compared with the arrangements illustrated in FIG. 4-1 and FIG. 4-2, thereby achieving a higher resolution.

The recording device 14 of the present embodiment transmits and records image information in a direction orthogonal to the scanning direction of the thermal recording label RL affixed to the container C for transportation as a recording target, under the control of the system control device 18. Therefore, if there is a difference between scanning of the thermal recording label RL and the transmission timing of image information in the orthogonal direction, the recording device 14 stores the image information into a memory, leading to increase in the amount of stored image. In such a case, the arrangement example of a plurality of array heads 44 illustrated in FIG. 4-4 can reduce the amount of information stored in the memory of the system control device 18, compared with the arrangement example of a plurality of array heads 44 illustrated in FIG. 4-3.

Further, FIG. 4-5 illustrates an example in which two array head groups, each having a plurality of array heads 44 illustrated in FIG. 4-4 in a staggered pattern, are stacked into a single array head group. Such array heads 44 in two array head groups stacked into a single array head group can be readily fabricated in manufacturing and can achieve a higher resolution. In addition, the arrangement example of array heads 44 illustrated in FIG. 4-5 can reduce the amount of information stored in the memory of the system control device 18, compared with the arrangement example of a plurality of array heads 44 illustrated in FIG. 4-4.

As illustrated in FIG. 2, the optical unit 43 as an example of the optical system includes a collimator lens 43*a* for converting divergent beams of laser light exiting from each optical fiber 42 into parallel beams and a condenser lens 43*b* for collecting laser light onto a surface of the thermal recording label RL serving as a laser irradiated surface. Whether to provide the optical unit 43 can be determined as appropriate depending on the purpose.

One of the commonly used recording methods is image-transfer of a plurality of laser light beams emitted from the laser emission parts 42*a* (see FIG. 3-2) onto a recording target at 1:1 by the optical unit 43. In this method, however, since laser light is collected and applied to a recording target in accordance with the spread angle (NA) of laser light emitted from the laser emission part 42*a*, the light collecting angle is the same as the spread angle (NA) of laser light.

The size of the array head 44 is determined by the number of laser emission parts 42*a*, and furthermore, the size of the optical system (optical unit 43) irradiated with laser light emitted from the laser emission parts 42*a* is also determined by the array heads 44. In other words, in the present embodiment, the laser light emitted from the laser emission parts 42*a* (outermost end laser emission parts) at the outermost ends positioned at both ends of the array head 44, of a plurality of laser emission parts 42*a*, passes through the vicinity of the end portions of the optical unit 43, whereas the laser light emitted from the laser emission parts 42*a* (center laser emission part) at the center of the array head 44 passes through the vicinity of the center portion of the optical unit 43. Therefore, when image transfer and light collection are performed by one optical system, the beam shape of laser light emitted from the laser emission part 42*a* at both ends and the center of the array head 44 may differ from each other due to the effect of lens aberration at the recording position of an image after collecting light. That the beam shape of laser light emitted from the laser emission part 42*a* at both ends and the center of the array head 44 differs from each other indicates that the beam diameter and the light distribution vary therebetween. If the beam shape of laser light differs in this manner, the energy density changes, and the image density differs between the center and both ends of an image recorded on a recording target. The image density at both ends is generally lower than the image density at the center.

A phenomenon also occurs in which the beam diameter at the image recording position is larger at both ends than at the center. In particular, when a source of laser light emitted from the optical fiber 42 is used, the light distribution of the emitted laser light is a top hat distribution. However, at the image recording position, a phenomenon additionally occurs in which the center of image transfer has a top hat distribution but the top hat distribution changes at both ends, so that the image density is significantly reduced at both ends relative to the center. This phenomenon occurs in a configuration in which the array head 44 has many light sources and increases in length and the effect of aberration of the optical system is large accordingly.

The image information output unit 47 such as a personal computer outputs image information to the controller 46. The controller 46 generates a drive signal for driving each driver 45 based on the input image information. The controller 46 transmits the generated drive signal to each driver 45. Specifically, the controller 46 includes a clock generator. When the number of clocks generated by the clock generator reaches a prescribed number of clocks, the controller 46 transmits a drive signal for driving each driver 45, to the driver 45.

Each driver 45, receiving the drive signal, drives the corresponding laser light-emitting element 41. The laser light-emitting element 41 emits laser light in accordance with the driving by the driver 45. The laser light emitted from the laser light-emitting element 41 enters the corresponding optical fiber 42 and exits the laser emission part 42*a* of the optical fiber 42. The laser light emitted from the laser emission part 42*a* of the optical fiber 42 is transmitted through the collimator lens 43*a* and the condenser lens 43*b* in the optical unit 43 and then irradiates the surface of the thermal recording label RL on the container C as a recording target. The surface of the thermal recording label RL irradiated with laser light is heated, whereby an image is recorded on the surface of the thermal recording label RL.

When a recording device that records an image on a recording target with laser light deflected by a galvano-mirror is used, an image such as character is recorded by emitting laser light so as to draw an image in one stroke with rotation of the galvano-mirror. In a case where a certain amount of information is recorded on a recording target, recording lags behind if the conveyance of the recording target is not stopped. Meanwhile, in the recording device 14 of the present embodiment, a laser array having a plurality of laser light-emitting elements 41 arranged in an array is used to record an image on a recording target by ON/OFF control of the laser light-emitting element 41 corresponding to each pixel. This configuration enables recording of an image on a recording target without stopping the conveyance of the container C even when the amount of information is large. Accordingly, the recording device 14 of the present embodiment can record an image without reducing the productivity even when a large amount of information is to be recorded on a recording target.

As will be described later, since the recording device 14 of the present embodiment records an image on a recording target by irradiating and heating the recording target with laser light, it is necessary to use laser light-emitting elements 41 with some high degree of power. For this reason, the amount of generated heat in the laser light-emitting elements 41 is large. In a conventional laser array recording device without a fiber array unit 14*b*, the laser light-emitting elements 41 need to be arranged in an array with spacing corresponding to the resolution. It follows that, in the conventional laser array recording device, the laser light-emitting elements 41 are arranged at extremely narrow pitches in order to achieve a resolution of 200 dpi. As a result, in the conventional laser array recording device, heat of the laser light-emitting elements 41 hardly escapes, leading to increase in the temperature of the laser light-emitting elements 41. In the conventional laser array recording device, if the laser light-emitting element 41 becomes hot, the wavelength and the light output of the laser light-emitting element 41 vary to prevent the recording target from being heated to a defined temperature, leading to a failure to produce a satisfactory image. In the conventional laser array recording device, in order to suppress such temperature increase of the laser light-emitting element 41, it is necessary to reduce the conveyance speed of the recording target to increase the light emission interval of the laser light-emitting element 41, preventing sufficiently high productivity.

The cooling unit 50 usually employs a chiller system. In this system, heating is not performed and only cooling is performed. Thus, although the temperature of the light source does not become higher than the setting temperature of the chiller, the temperature of the cooling unit 50 and the laser light-emitting element 41 serving a laser light source in contact therewith varies depending on the environment temperature. When a semiconductor laser is used as the laser light-emitting element 41, a phenomenon occurs in which the laser output changes with the temperature of the laser light-emitting element 41 (the laser output is high when the temperature of the laser light-emitting element 41 is low). Therefore, in order to control the laser output, it is preferable to perform normal image formation by measuring the temperature of the laser light-emitting element 41 or the temperature of the cooling unit 50 and controlling an input signal to the driver 45 which controls the laser output such that the laser output is constant in accordance with the measurement result.

In this respect, the recording device 14 of the present embodiment is a fiber array recording device including the fiber array unit 14*b*. With the use of the fiber array recording device, it is only necessary to arrange the laser emission parts 42*a* of the fiber array unit 14*b* with pitches corresponding to the resolution, and there is no need for setting the pitch between the laser light-emitting elements 41 of the laser array unit 14*a* to a pitch corresponding to the image resolution. With this configuration, in the recording device 14 of the present embodiment, the pitch between the laser light-emitting elements 41 can be wide enough to sufficiently dissipate heat of the laser light-emitting element 41. Accordingly, the recording device 14 of the present embodiment can prevent the laser light-emitting element 41 from becoming hot and suppress variations of the wavelength and the light output of the laser light-emitting element 41. As a result, the recording device 14 of the present embodiment can record a satisfactory image on a recording target. Further, even when the light emission interval of the laser light-emitting element 41 is short, temperature increase of the laser light-emitting element 41 can be prevented, and the conveyance speed of the container C can be increased, thereby increasing the productivity.

In the recording device 14 of the present embodiment, the cooling unit 50 is provided to liquid-cool the laser light-emitting element 41, thereby further preventing temperature increase of the laser light-emitting element 41. Consequently, in the recording device 14 of the present embodiment, the light emission interval of the laser light-emitting element 41 can be further reduced, and the conveyance speed of the container C can be increased, thereby increasing the productivity. In the recording device 14 of the present embodiment, the laser light-emitting element 41 is liquid-cooled. However, the laser light-emitting element 41 may be air-cooled, for example, using a cooling fan. Liquid cooling has higher cooling efficiency than air-cooling and has the advantage of cooling the laser light-emitting element 41 well. By contrast, air-cooling is inferior to liquid cooling in cooling efficiency but has the advantage of cooling the laser light-emitting element 41 inexpensively.

FIG. 5 is a block diagram illustrating part of an electric circuit in the image recording system 100. In this figure, the system control device 18 includes a CPU, a RAM, a ROM, and a nonvolatile memory and controls driving of the devices in the image recording system 100 and performs a variety of arithmetic operations. This system control device 18 is connected with the conveyor device 10, the recording device 14, the reading device 15, the operation panel 181, and the image information output unit 47.

The operation panel 181 includes a touch panel display and a variety of keys to display an image and accept a variety of information input through key operation by the operator.

Also connected are a first temperature sensor 182 serving as a recording target temperature detection unit for detecting the surface temperature of a recording target and a second temperature sensor 183 serving as an environment temperature detection unit for detecting the environment temperature. As illustrated in FIG. 1, the first temperature sensor 182 is provided on a wall surface of the shielding cover 11 opposed to the thermal recording label RL. As illustrated in FIG. 1, the second temperature sensor 183 is provided on a wall surface of the system control device 18.

As illustrated in FIG. 5, the CPU operates under instructions of a program stored in the ROM or the nonvolatile memory to allow the system control device 18 to function as an output control unit. The output control unit controls the output of the laser light-emitting element 41 corresponding to each laser emission part 42*a*.

Specifically, for example, the output control unit performs control such that the energy of laser light exiting from the outermost end laser emission part that emits laser light to be transmitted through the vicinity of the end portion of the optical unit 43, of a plurality of laser emission parts 42*a*, is greater than the energy of laser light exiting from the center laser emission part that emits laser light to be transmitted through a portion other than the end portion of the optical unit 43. For example, the output control unit performs control such that the energy of laser light exiting from the end laser emission part positioned at the end of the array head 44 (laser head unit), excluding the outermost end laser emission part, is greater than the energy of laser light exiting from a laser emission part other than the outermost end laser emission part and the end laser emission part.

For example, the output control unit controls output of laser light exiting from each laser emission part 42*a* in accordance with the distance in the X-axis direction between the array heads 44 and/or the conveyance speed (relative moving speed) of the container C serving as a recording target relative to the laser emission part 42*a*. For example, the output control unit controls the output of laser light exiting from each laser emission part 42*a* in accordance with the surface temperature (detection result) of a recording target detected by the first temperature sensor 182 and/or the environment temperature (detection result) detected by the second temperature sensor 183. The output control unit also controls the output of laser light exiting from the laser emission part 42*a*, based on whether laser light is emitted from the adjacent laser emission part. The output control unit also controls the energy of laser light emitted from the laser emission part 42*a* in accordance with the temperature of the laser light-emitting element 41. The output control unit allows the laser emission part 42*a* to emit laser light to record an image on a recording medium while the conveyor device 10 (recording target conveyance unit) conveys the recording target.

An example of the operation of the image recording system 100 will now be described with reference to FIG. 1. First of all, a container C containing packages is placed on the conveyor device 10 by an operator. The operator places the container C on the conveyor device 10 such that a side surface of the body of the container C with a thermal recording label RL is positioned on the −Y side, that is, such that the side surface is opposed to the recording device 14.

The operator operates the operation panel 181 to start the system control device 18, so that a conveyance start signal is transmitted from the operation panel 181 to the system control device 18. The system control device 18, receiving the conveyance start signal, starts driving the conveyor device 10. The container C placed on the conveyor device 10 is then conveyed by the conveyor device 10 toward the recording device 14. The conveyance speed of the container C is, for example, 2 [m/sec].

Upstream from the recording device 14 in the conveyance direction of the container C, a sensor is arranged for detecting the container C conveyed on the conveyor device 10. When this sensor detects a container C, a detection signal is transmitted from the sensor to the system control device 18. The system control device 18 has a timer. The system control device 18 starts counting the time using the timer at a timing when it receives the detection signal from the sensor. The system control device 18 then grasps the timing when the container C reaches the recording device 14, based on the elapsed time since the timing of receiving the detecting signal.

At the timing when the elapsed time since the timing of receiving the detection signal is T1 and the container C reaches the recording device 14, the system control device 18 outputs a recording start signal to the recording device 14 so as to record an image on the thermal recording label RL affixed to the container C passing through the recording device 14.

The recording device 14, receiving the recording start signal, irradiates the thermal recording label RL on the container C moving relative to the recording device 14 with laser light having a predetermined power, based on the image information received from the image information output unit 47. An image is thus recorded on the thermal recording label RL in a contactless manner.

The image recorded on the thermal recording label RL (image information transmitted from the image information output unit 47) is, for example, a character image such as contents of the packages contained in the container C and destination information, and a code image such as barcode and two-dimensional code (for example, QR codes), which are coded information such as contents of the packages contained in the container C and destination information.

The container C having an image recorded during the course of passing through the recording device 14 passes through the reading device 15. At this point of time, the reading device 15 reads the code image such as barcode and two-dimensional code recorded on the thermal recording label RL and acquires information such as the contents of packages contained in the container C and destination information. The system control device 18 compares information acquired from the code image with image information transmitted from the image information output unit 47 and checks whether the image is recorded correctly. When the image is recorded correctly, the system control device 18 sends the container C to the next step (for example, transportation preparation step) through the conveyor device 10.

When the image is not recorded correctly, the system control device 18 temporarily stops the conveyor device 10 and provides display on the operation panel 181 to indicate that the image is not correctly recorded. When the image is not correctly recorded, the system control device 18 may convey the container C to a prescribed destination.

Discussed below is a case where the array heads 44 as an example of the laser head unit are arrayed in the Z-axis direction (predetermined direction) and arranged at positions different from adjacent array heads 44 in the X-axis direction orthogonal to the Z-axis direction, as illustrated in FIG. 4-2. In the case where the array heads 44 are arranged in this manner, the image density of dots corresponding to the laser emission parts 42*a*(1), 42*a*(*n*), 42*a*(*n*+1), 42*a*(2*n*), and 42*a*(2*n*+1), 42*a*(3*n*) (see FIG. 6) of the optical fibers 42 positioned at the ends of the array heads 44 is lower than the prescribed image density. It has been found that this defect occurs for the reasons below. That is, the laser light exiting from the laser emission part 42*a* of the optical fiber 42 affects not only a dot corresponding to the optical fiber 42 but also a dot corresponding to the optical fiber 42 adjacent to the dot in the Z-axis direction. The temperature of the dot then rises to a coloring temperature K4 due to the effect of laser light exiting from the laser emission part 42*a* corresponding to the dot and laser light exiting from the adjacent laser emission parts 42*a*, and color is developed at a prescribed image density.

When the array heads 44 are arranged in a staggered pattern as illustrated in FIG. 4-2, the laser emission part (42*a*(1), 42*a*(*n*), 42*a*(*n*+1) . . . (see FIG. 6)) positioned at an end of the array head 44 is adjacent to the laser emission part 42*a* only on one side. The dot corresponding to the laser emission part 42*a*(1) (hereinafter referred to as the outermost end laser emission part) positioned at the outermost end in the Z-axis direction illustrated in FIG. 6, of the laser emission parts 42*a* positioned at the ends of the array heads 44, is affected only by the laser light emitted from the laser emission part 42*a*(2) adjacent to the laser emission part 42*a*(1). Accordingly, the temperature of the recording layer of the thermal recording label RL does not rise to the coloring temperature, and a color is not developed well, resulting in a lower image density. In the present embodiment, the laser light emitted from the outermost end laser emission part passes through the vicinity of the end portion of the optical unit 43 (see FIG. 2).

As for the laser emission part (hereinafter referred to as the end laser emission part) positioned at an end of the array head 44, excluding the outermost end laser emission parts, such as laser emission parts 42*a*(*n*) and 42*a*(*n*+1) illustrated in FIG. 6, the end laser emission part of another array head 44 is present at a distance of d [mm] in the X-axis direction at the same pitch as the adjacent laser emission part in the Z-axis direction. Therefore, the dot corresponding to the end laser emission part is affected by the laser light from the adjacent laser emission part and the laser light from the end laser emission part of another array head 44. However, the end laser emission part is spaced apart from the end laser emission part of another array head 44 by d [mm] in the X-axis direction. Therefore, it takes a predetermined time for laser light to be emitted from the end laser emission part of the array head 44 downstream (the +X-axis direction side) in the conveyance direction of the container C after laser light is emitted from the end laser emission part of the array head 44 upstream (the −X-axis direction side) in the conveyance direction of the container C. The corresponding dot cools during this predetermined time, and even when this dot is heated by laser light exiting from the end laser emission part of another array head 44, the temperature of the dot does not reach the coloring temperature, resulting in a low image density.

For this reason, in the configuration illustrated in FIG. 4-2, the array heads 44 need to be arranged such that the distance d in the X-axis direction between adjacent array heads 44 is minimized. However, the distance in the X-axis direction from the physically adjacent array head 44 is unable to be reduced enough because of the length in the X-axis direction of the array head 44, the length in the X-axis direction of the collimator lens 43*a* and the condenser lens 43*b* included in the optical unit 43, and the length in the X-axis direction of the optical system holding member that holds the collimator lens 43*a* and the condenser lens 43*b*.

In the arrangement as illustrated in FIG. 4-3, the image density is also low at a part of the recording target irradiated with laser light exiting from the laser emission part positioned at the end of the array head 44, in the same manner as in the staggered arrangement in FIG. 4-2.

In Patent Literature 2, reduction in image density at an end is suppressed by increasing the core diameter of the optical fiber disposed at the end of the fiber array. However, when the core diameter is increased, the beam diameter of laser light emitted from the laser emission part of the optical fiber increases, and the energy density of laser light decreases. Therefore, the temperature of the dot fails to increase to the coloring temperature, and reduction of the image density fails to be alleviated.

In the present embodiment, the output control unit of the system control device 18 then performs control such that optical energy of laser light exiting from the laser emission part (the outermost end laser emission part and the end laser emission part) positioned at the end of the array head 44 is higher than the optical energy of laser light exiting from other laser emission parts. Specifics will be described below. As used herein, the outermost end or the end is not applied to a single element but includes a few elements (about 5% of all the elements in one array) inside from there.

Figure 6:
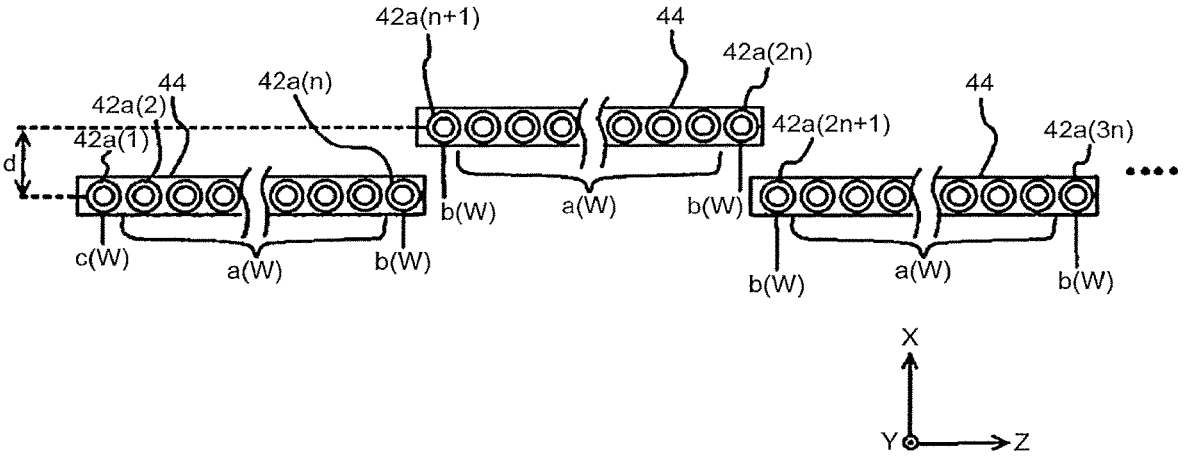
FIG. 6 is a diagram illustrating outputs of laser light-emitting elements corresponding to laser emission parts.

FIG. 6 is a diagram illustrating the outputs of the laser light-emitting elements 41 corresponding to the laser emission parts 42*a*. In FIG. 6, the laser emission parts 42*a* are arranged side by side in the Z-axis direction (predetermined direction). As illustrated in FIG. 6, the output of the laser light-emitting element 41 corresponding to the outermost end laser emission part (for example, 42*a*(1)) positioned at the outermost end in the Z-axis direction, of the laser emission parts 42*a* positioned at the ends of the array heads 44, is c [W]. The output of the laser light-emitting element 41 corresponding to the end laser emission part (for example, 42*a*(*n*) and 42*a*(*n*+1), excluding the one described above, positioned at the end of the array head 44 is b [W]. The output of the laser light-emitting element 41 corresponding to the laser emission part at the center (other laser emission part) adjacent to the laser emission parts on both sides is a [W]. The relation of outputs of the laser light-emitting elements 41 is $a<b\leq c$. In this way, the output of the laser light-emitting element 41 corresponding to the outermost end laser emission part or the end laser emission part is higher than the output of the laser light-emitting element 41 corresponding to the laser emission part at the center, so that the optical energy of the laser light exiting from the outermost end laser emission part or the end laser emission part is higher than the optical energy of laser light exiting from the laser emission part at the center.

In the present embodiment, the output control unit performs control such that the energy of laser light exiting from the end laser emission part is not less than 103% to not more than 150% of the energy of laser light exiting from other laser emission parts. That is, in FIG. 6, the output a is 5.0 [W], and the output b and the output c are set to 103% to 150% of the output a. Setting the output b and the output c to 103% or more of the output a can make the image density unevenness less noticeable. Setting the outputs b and c to 150% or less of the output a prevents the recording target from being heated to the coloring temperature or higher and restrains the recording target from burning. The above-noted range can be set as appropriate, for example, according to the characteristics of the recording target to be used and the characteristics of the laser light-emitting element 41.

The output of each laser light-emitting element 41 can be set to a desired output by adjusting voltage and current to be applied to the laser light-emitting element 41.

It is preferable that the output b [W] of the laser light-emitting element 41 corresponding to the end laser emission part is set based on, for example, the distance d [mm] in the X-axis direction between the array heads 44 and the conveyance speed v [m/sec] of the container C. That is, as the distance d [mm] decreases, the time decreases taken for laser light to be emitted from the laser emission part 42*a* arranged in the array head 44 downstream in the conveyance direction (the +X-axis direction side) after laser light is emitted from the laser emission part 42*a* arranged in the array head 44 upstream in the conveyance direction (the −X-axis direction side). Thus, when laser light exits from the end laser emission part of the array head 44 downstream in the conveyance direction (the +X-axis direction side), the effect of temperature increase by laser light from the end laser emission part of the array head 44 upstream in the conveyance direction (the −X-axis direction side) still remains. Therefore, the temperature of the corresponding dot can be increased to the coloring temperature without increasing optical energy so much. By contrast, as the distance d [mm] in the X-axis direction between the array heads 44 increases, the effect of the temperature increase decreases, and the temperature of the corresponding dot is unable to be increased to the coloring temperature unless the output of the laser light-emitting element 41 is increased and the optical energy of laser light irradiating the recording target is increased.

Similarly, as the conveyance speed v [m/sec] of the container C increases, the time decreases taken for laser light to be emitted from the laser emission part of the array head 44 downstream in the conveyance direction (the +X-axis direction side) after laser light is emitted from the laser emission part of the array head 44 upstream in the conveyance direction (the −X-axis direction side). Thus, in this case, the temperature of the corresponding dot can be increased to the coloring temperature even when the output of the laser light-emitting element 41 corresponding to the end laser emission part is not so large. By contrast, as the conveyance speed decreases, the effect of temperature increase decreases, and the temperature of the corresponding dot is unable to be increased to the coloring temperature unless the output of the laser light-emitting element 41 corresponding to the end laser emission part is increased and the optical energy of laser light irradiating the recording target is increased. In this way, the output control unit controls the energy of laser light exiting from the end laser emission part, excluding the outermost end laser emission part, depending on the relative moving speed of a recording target.

Alternatively, the output of the laser light-emitting element 41 corresponding to the end laser emission part may be set to a value equal to the output c [W] of the laser light-emitting element 41 corresponding to the outermost end laser emission part, rather than based on the distance d [mm] in the X-axis direction between the array heads 44 and the conveyance speed v [m/sec] of the container C. This configuration also enables the temperature of the dot corresponding to the end laser emission part to increase to the coloring temperature. However, in this case, the recording target is irradiated with laser light having optical energy higher than necessary, which may cause reduction of recording density or burning of the recording target.

The recording target therefore can be irradiated with laser light with optimum optical energy by setting the output b [W] based on the conveyance speed v [m/sec] of the container C and the distance d [mm] in the X-axis direction between the array heads 44. This configuration enables the temperature of the dot corresponding to the end laser emission part to increase to the coloring temperature and suppress reduction of recording density and burning of the recording target.

Further, the user can set the conveyance speed v [m/sec] of the container C as appropriate. Therefore, when the user operates the operation panel 181 to change the conveyance speed v [m/sec] of the container C, the system control device 18 changes the output b [W].

Further, the temperature drop in a period from when laser light exits from the laser emission part 42*a* in the array head 44 upstream in the conveyance direction (the −X-axis direction side) to when laser light exits from the laser emission part 42*a* of the array head 44 downstream in the conveyance direction (the +X-axis direction side) varies depending on the temperature of the recording target and/or the environment temperature. More specifically, when the temperature of the recording target and the environment temperature are high, heat is less likely to escape, and a temperature drop is suppressed. Therefore, when laser light exits from the end laser emission part of the array head 44 downstream in the conveyance direction (the +X-axis direction side), the effect of temperature increase by laser light from the end laser emission part of the array head 44 upstream in the conveyance direction (the −X-axis direction side) still remains. Thus, when the temperature of the recording target and/or the environment temperature is higher than normal temperature, the optical energy of laser light is reduced by reducing the output b [W] compared with at normal temperature (brought closer to the output a [W]). By contrast, when the temperature is lower than normal temperature, heat escapes to the surrounding and therefore the temperature drop is large. Therefore, when laser light exits from the end laser emission part of the array head 44 downstream in the conveyance direction (the +X-axis direction side), the effect of the temperature increase by laser light from the end laser emission part of the array head 44 upstream in the conveyance direction (the −X-axis direction side) almost disappears. Thus, when the temperature is lower than normal temperature, the optical energy of laser light is increased by increasing the output b [W] compared with normal temperature (brining closer to the output c [W]). In this way, the output control unit controls the energy of laser light exiting from the end laser emission part, depending on the temperature of the recording target and/or the environment temperature.

Figure 7:
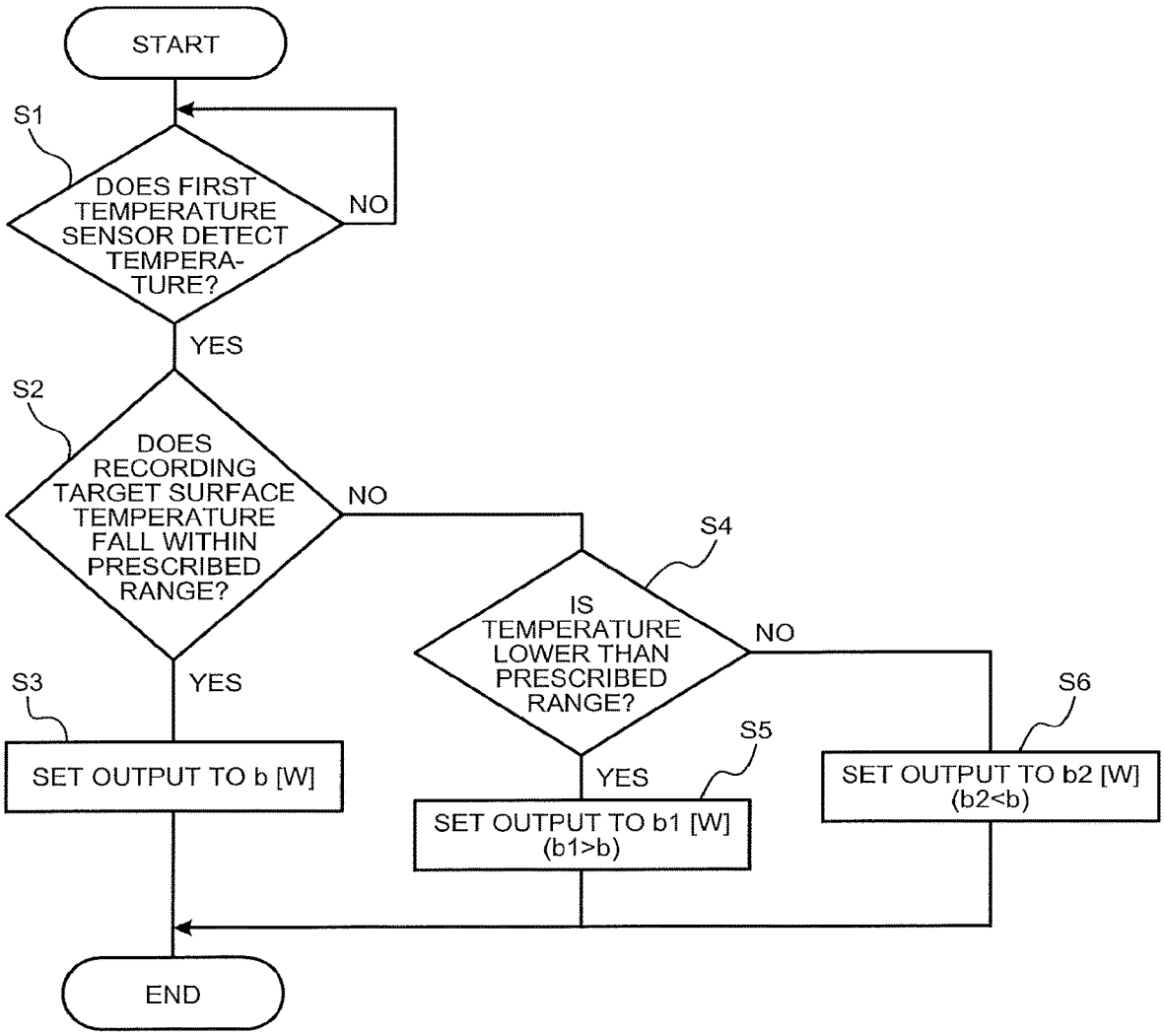
FIG. 7 is a diagram illustrating a control flow of changing output of a laser light-emitting element corresponding to an end laser emission part, based on a detection result of a first temperature sensor.

FIG. 7 is a diagram illustrating an example of the control flow of changing the output b [W] of the laser light-emitting element 41 corresponding to the end laser emission part, based on the detection result of the first temperature sensor 182 detecting the surface temperature of a recording target. As illustrated in FIG. 7, the output control unit monitors whether the first temperature sensor 182 has detected the surface temperature of the recording target (S1). In the present embodiment, the temperature of the thermal recording label RL serving as a thermal recording part of the recording target is detected by the first temperature sensor 182.

If the first temperature sensor 182 detects the surface temperature of the recording target moving with the container C, the output control unit checks whether the surface temperature of the recording target detected by the first temperature sensor 182 falls within a prescribed temperature range (S2). The prescribed temperature range is, for example, normal temperature (15 to 25° C.). When the surface temperature of the recording target falls within the prescribed temperature range (Yes at S2), the output control unit sets the output of the laser light-emitting element 41 corresponding to the end laser emission part to b [W] (S3).

When the surface temperature of the recording target falls outside the prescribed temperature range (No at S2), the output control unit determines whether the surface temperature of the recording target is lower than the prescribed temperature range (S4). When the surface temperature of the recording target is lower than the prescribed temperature range (Yes at S4), the output control unit sets the output of the laser light-emitting element 41 corresponding to the end laser emission part to a value b1 [W] greater than b [W] (S5). The output control unit thus increases the optical energy of laser light compared with the case in which the surface temperature is in the prescribed temperature range. At a temperature lower than the prescribed range, the effect of temperature increase by laser light from the end laser emission part of the array head 44 upstream in the conveyance direction (the −X-axis direction side) almost disappears when laser light exits from the end laser emission part of the array head 44 downstream in the conveyance direction (the +X-axis direction side), as described above. Therefore, at a temperature lower than the prescribed temperature range, the output control unit sets the output of the laser light-emitting element 41 corresponding to the end laser emission part to a value b1 [W] that is greater than b [W] to increase the optical energy of laser light. Accordingly, even when the recording target has a low temperature, the temperature of the dot corresponding to the laser light-emitting element 41 corresponding to the end laser emission part can be increased to the coloring temperature to achieve a prescribed image density.

When the surface temperature of the recording target is higher than the prescribed temperature range (No at S4), the output control unit sets the output of the laser light-emitting element 41 corresponding to the end laser emission part to a value b2 [W] that is smaller than b [W] (S6). The output control unit thus reduces the optical energy of laser light compared with the case in which the surface temperature is in the prescribed temperature range. At a temperature higher than the prescribed temperature range, the effect of temperature increase by laser light from the end laser emission part of the array head 44 upstream in the conveyance direction (the −X-axis direction side) still remains when laser light exits from the end laser emission part of the array head 44 downstream in the conveyance direction (the +X-axis direction side), as described above. Therefore, even when the optical energy of laser light is reduced, the temperature of the dot corresponding to the laser light-emitting element 41 corresponding to the end laser emission part can be increased to the coloring temperature. Thus, at a temperature higher than the prescribed temperature range, the output control unit sets a value b2 [W] that is smaller than the output b [W] of the laser light-emitting element (S6) to reduce the optical energy of laser light. This configuration can suppress burning of the recording target and recording density reduction and can increase the temperature of the dot corresponding to the laser light-emitting element 41 corresponding to the end laser emission part to the coloring temperature. As a result, a prescribed image density can be achieved.

In FIG. 7, an example in which the output b [W] of the laser light-emitting element 41 corresponding to the end laser emission part is changed based on the surface temperature of the recording target has been described. However, the output b [W] of the laser light-emitting element 41 corresponding to the end laser emission part may be changed based on the environment temperature detected by the second temperature sensor 183. Alternatively, the output b [W] of the laser light-emitting element 41 may be changed based on the detection result of the surface temperature of the thermal recording label RL by the first temperature sensor 182 and the detection result of the environment temperature by the second temperature sensor 183. In the foregoing, the temperature of the thermal recording label RL serving as a thermal recording part of the recording target is detected by the first temperature sensor 182. However, the temperature of the container C serving as the structure of the recording target may be detected by the first temperature sensor 182, and the output b [W] may be changed based on the temperature of the container C.

In the foregoing, the output b [W] is changed based on three levels, namely, a prescribed temperature range, temperatures lower than the prescribed temperature range, and temperatures higher than the prescribed temperature range. However, the temperature range may be divided more finely so that the output b [W] of the laser light-emitting element 41 is changed finely.

Alternatively, the temperature of each individual recording target may be detected, and the output b [w] may be changed based on the temperature detection result of each individual recording target. Since the environment temperature or the temperature of the recording target usually does not change abruptly, the output b [W] may be changed based on the temperature detection result when a predetermined time elapses or when the number of times of image recording exceeds a prescribed number.

When the temperature of the recording target and/or the environment temperature is high, the temperature can be increased to the coloring temperature even with low optical energy of laser light, whereas when the temperature of the recording target and/or the environment temperature is low, the temperature is unable to be increased to the coloring temperature unless the optical energy of laser light is increased. Therefore, the output a [W] of the laser light-emitting element 41 corresponding to the laser emission part at the center adjacent to the laser emission parts on both sides may also be changed based on the temperature of the recording target and/or the environment temperature. Similarly, the output c [W] of the laser light-emitting element 41 corresponding to the outermost end laser emission part may also be changed based on the temperature of the recording target and/or the environment temperature.

The output control unit controls the energy of laser light exiting from the laser emission part 42*a*, based on whether laser light is emitted from the adjacent laser emission part 42*a*. That is, when laser light is not emitted from the adjacent laser emission part, there is no effect of laser light exiting from the adjacent laser emission part, and the temperature of the dot does not increase to the coloring temperature. Therefore, the output of the laser light-emitting element 41 may be changed based on ON/OFF of the adjacent laser light-emitting element 41. Specifically, when the adjacent laser light-emitting element 41 is OFF and does not emit laser light, the optical energy is increased by increasing the output of the laser light-emitting element 41. Thus, even when laser light is not emitted from the adjacent laser emission part, the temperature of the dot can be increased to the coloring temperature, thereby achieving a prescribed image density.

When the array heads 44 are arranged as illustrated in FIG. 4-3, the adjacent optical fibers 42 are spaced apart from each other by a predetermined distance in the X-axis direction. Therefore, the output of each laser light-emitting element 41 is set higher than in the staggered arrangement in FIG. 4-2.

The output control unit may control the energy of laser light emitted from the laser emission part 42*a* in accordance with the temperature of the laser light-emitting element 41. This configuration can correct and suppress variations of output of laser light attributed to the temperature of the laser light-emitting element 41 and enables recording of a satisfactory image on the recording target.

The output control unit may record an image on a recording target by allowing the laser emission part 42*a* to emit laser light while allowing the conveyor device 10 (recording target conveyance unit) to convey the recording target. This configuration can increase the productivity compared with when the recording target is temporarily stopped and the recording device 14 is moved to record an image on the recording target.

Figures 1, 8:
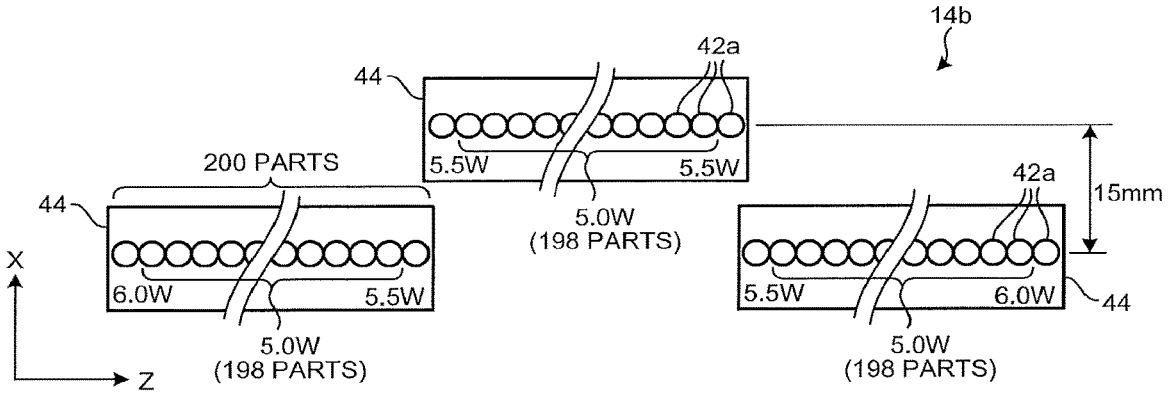
Figures 2, 8:
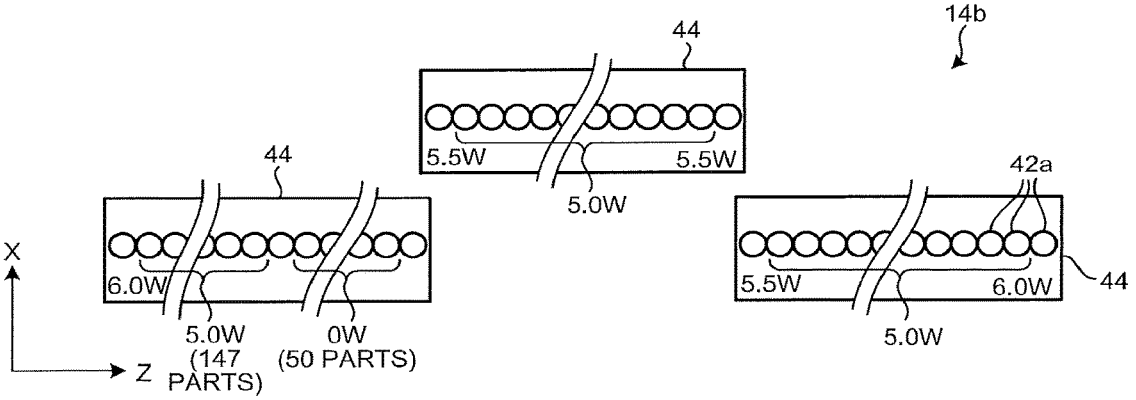
Figures 3, 8:
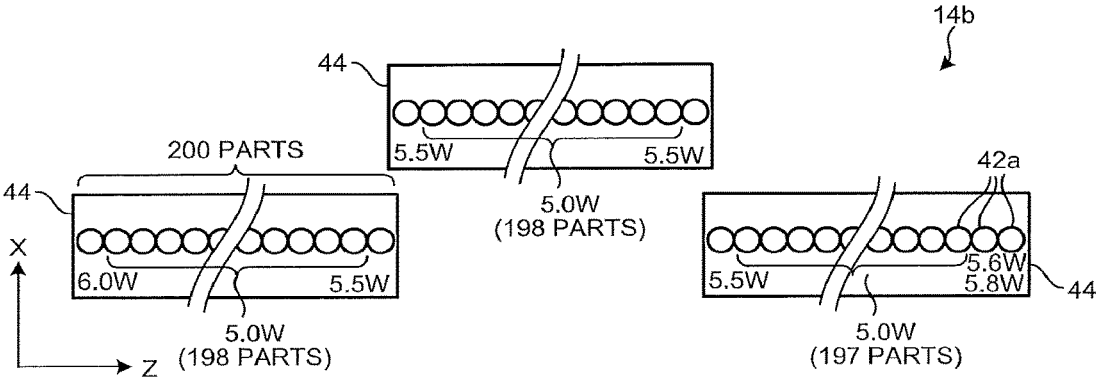
Figures 4, 8:
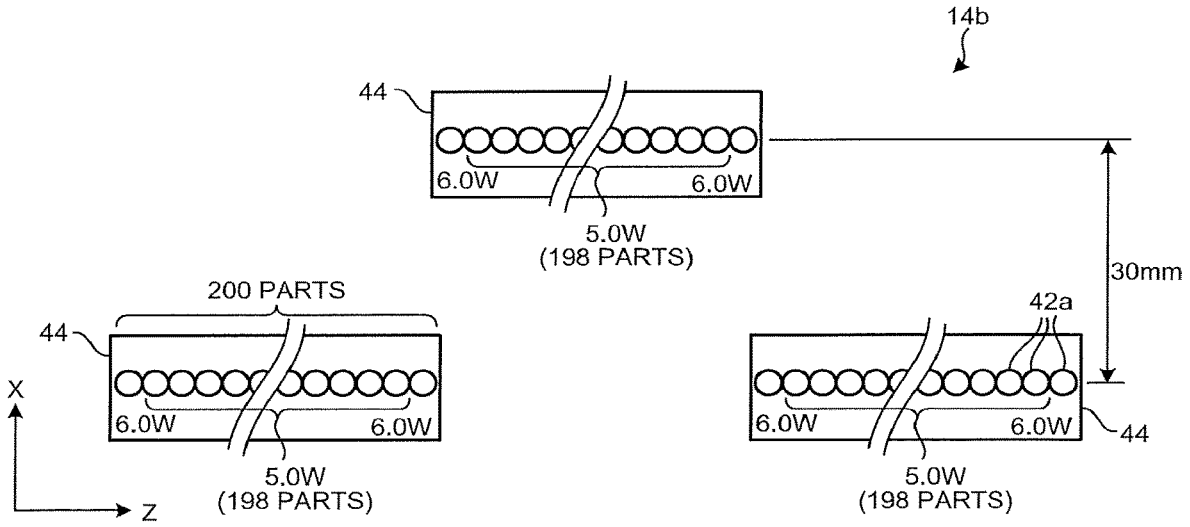
Figures 5, 8:
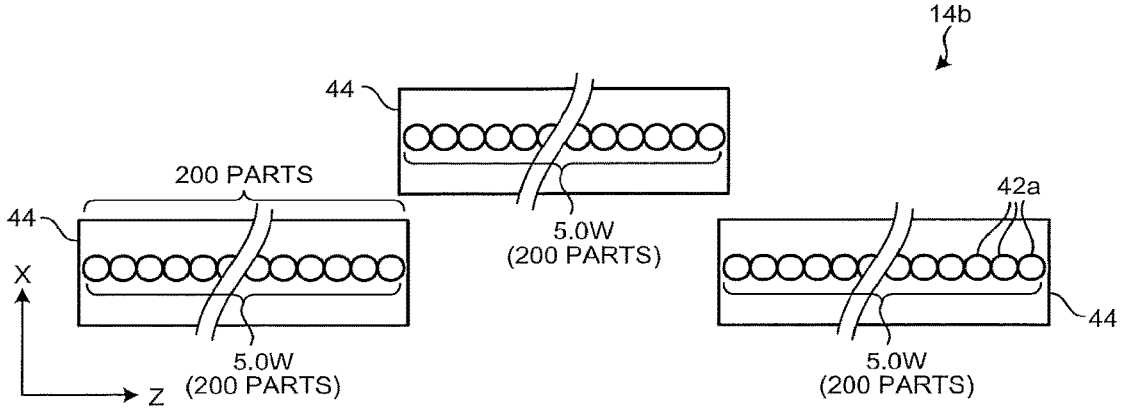

The verification experiment conducted by the applicant will now be described. FIG. 8-1 is a diagram illustrating the output of each laser light-emitting element 41 in Example 1 and the distance in the X-axis between the adjacent array heads. FIG. 8-2 is a diagram illustrating the output of each laser light-emitting element 41 in Example 2 and the distance in the X-axis direction between the adjacent array heads. FIG. 8-3 is a diagram illustrating the output of each laser light-emitting element 41 in Example 3 and the distance in the X-axis direction between the adjacent array heads. FIG. 8-4 is a diagram illustrating the output of each laser light-emitting element 41 in Example 4 and the distance in the X-axis direction between the adjacent array heads. FIG. 8-5 is a diagram illustrating the output of each laser light-emitting element 41 in Comparative Example and the distance in the X-axis direction between the adjacent array heads. FIG. 8-1 to FIG. 8-5 illustrate the array of a plurality of array heads of the fiber array unit 14*b* in the recording device 14.

Example 1

As illustrated in FIG. 8-1, in Example 1, the distance d in the X-axis direction between the adjacent array heads 44 was 15 [mm], and the output of the laser light-emitting element 41 corresponding to the laser emission part at the center adjacent to the laser emission parts on both sides was 5.0 W. The output of the laser light-emitting element 41 corresponding to the outermost end laser emission part positioned on the outermost end in the Z-axis direction was set to 6.0 W, which was 120% of the output of the laser light-emitting element 41 corresponding to the laser emission part at the center. The output of the laser light-emitting element 41 corresponding to the end laser emission part positioned at the end of the array head 44, excluding the outermost end laser emission part, was set to 5.5 W, which was 110° of the output of the laser light-emitting element corresponding to the laser emission part at the center.

Example 2

As illustrated in FIG. 8-2, in Example 2, the laser light-emitting elements 41 corresponding to 50 laser emission parts from the laser emission part adjacent to the end laser emission part of the array head 44 arranged at the left end in the figure were OFF (0 W), and the output of the laser light-emitting element 41 corresponding to the 51st laser emission part was set to 6.0 W. The settings were the same as in Example 1 except that the output of the laser light-emitting element 41 corresponding to the end laser emission part to the immediate right of the group of laser light-emitting elements 41 set OFF (0 W) was set to 6.0 W.

Example 3

As illustrated in FIG. 8-3, in Example 3, the settings were the same as in Example 1 except that the output of the laser light-emitting element 41 corresponding to the outermost end laser emission part of the array head 44 arranged on the right end in the figure was set to 5.8 W and the output of the laser light-emitting element 41 corresponding to the laser emission part to the immediate left was set to 5.6 W.

Example 4

As illustrated in FIG. 8-4, in Example 4, the settings were the same as in Example 1 except that the distance in the X-axis direction between adjacent array heads 44 was 30 [mm] and the output of the laser light-emitting element 41 corresponding to the end laser emission part was 6.0 W.

Comparative Example 1

As illustrated in FIG. 8-5, in Comparative Example 1, the settings were the same as in Example 1 except that the output of all the laser light-emitting elements 41 was 5.0 W.

Images were created using the recording devices of Examples 1 to 4 and Comparative Example 1, and the images were evaluated as to whether there was density unevenness by visual inspection and visual inspection with a ×5 magnifying glass. The vicinity of the portion corresponding to the vicinity of the outermost end of the array head 44, the vicinity of the portion corresponding to the end, and the vicinity corresponding to the boundary between a white portion and a black portion in Example 2 were observed. The result is shown in Table 1.

TABLE 1

| | Density unevenness |
|---|---|
| Example 1 | ◎ |
| Example 2 | ◎ |
| Example 3 | ○ |

TABLE 1-continued

| | Density unevenness |
|---|---|
| Example 4 | ○ |
| Comparative Example 1 | X |

◎: less noticeable in observation with x5 magnifying glass
○: less noticeable by visual inspection
X: noticeablef As is clear from Table 1, the density unevenness was not recognized by visual inspection in Examples 1 to 4. By contrast, in Comparative Example 1, a portion with low image density was recognized in a place corresponding to the end of the array head 44 and an end portion in the Z-axis direction of a solid image, and density unevenness was recognized.

The reason for this is that in Comparative Example 1, the outputs of all the laser light-emitting elements 41 are set to 5.0 W. Therefore, the temperature of the place corresponding to the end portion of the array head 44 or the end portion in the Z-axis direction of the image did not increase to the coloring temperature K4, and in Comparative Example 1, a portion with low image density was recognized at the place corresponding to the end of the array head 44 and the end portion in the Z-axis direction of the solid image, and density unevenness appears.

In Example 1, the output of the laser light-emitting element 41 corresponding to the outermost end laser emission part was set to 6.0 W, and the output of the laser light-emitting element 41 corresponding to the end laser emission part was set to 5.5 W, which was greater than the output (5.0 W) of the laser light-emitting element 41 corresponding to the laser emission part at the center, thereby increasing the optical energy of the laser irradiating the recording target. As a result, the temperature of the place corresponding to the end of the array head 44 and the end portion in the Z-axis direction of the image can be increased to the coloring temperature, so that the place corresponding to the end of the array head 44 and the end portion in the Z-axis direction of the image achieve a prescribed image density, and the density unevenness is less noticeable.

In Example 3, in the array head 44 arranged on the right end in the figure, a few laser emission parts (about 5% of all the laser emission parts in one array head 44) inside of the outermost end were set as the outermost end laser emission parts. The outputs of the laser light-emitting elements 41 corresponding to these outermost end laser emission parts were set to 5.6 W and 5.8 W, which were greater than the output (5.0 W) of the laser light-emitting element 41 corresponding to the laser emission part at the center, thereby increasing the optical energy of the laser radiating the recording target. In this manner, a few laser emission parts (about 5% of all the laser emission parts in one array head 44) were set as the outermost end laser emission parts to increase the optical energy compared with the one emitted from the laser emission part at the center, thereby making image density unevenness at the end portion in the +Z-axis direction less noticeable by visual inspection. As a result, when a few laser emission parts (about 5% of all the laser emission parts in one array head 44) inside of the outermost end were set as the outermost end laser emission parts to increase the optical energy compared with the one emitted from the laser emission part at the center, the temperature was also increased to the coloring temperature, and the end portion in the Z-axis direction of the image can achieve a prescribed image density.

In Example 4, the distance in the X-axis direction between adjacent array heads 44 is increased such that the distance in the X-axis direction between adjacent array heads 44 is 30

[mm]. With the distance of 30 [mm], the effect of temperature increase by the laser light from the end laser emission part of the array head 44 upstream in the conveyance direction almost disappears when the end laser emission part of the array head 44 downstream in the conveyance direction emits laser light. However, the output of the laser light-emitting element 41 corresponding to the end laser emission part was set to 6.0 W, which is equal to the output of the laser light-emitting element 41 corresponding to the outermost end laser emission part. This setting is thought to have increases the temperature to the coloring temperature to achieve a prescribed image density and made density unevenness less noticeable.

In Example 2, the output of the laser light-emitting element 41 adjacent to the laser light-emitting element 41 set OFF is increased. When laser light is not emitted from the adjacent laser emission part, there is no effect of laser light exiting from the adjacent laser emission part. However, the outputs of the laser light-emitting elements 41 adjacent to the laser light-emitting element 41 set OFF are increased to increase the optical energy. This setting is thought to have enabled coloring at a prescribed density and made image density unevenness less noticeable.

This verification experiment has proven that the density unevenness can be made less noticeable by increasing the output of the laser light-emitting element 41 corresponding to at least the outermost end laser emission part and/or the end laser emission part arranged at the end of the array head 44, compared with the output of the laser light-emitting element 41 corresponding to the laser emission part at the center adjacent to the optical fibers 42 on both sides. In addition, Example 3 has proven that density unevenness can be made less noticeable by changing the output of the laser light-emitting element 41 corresponding to the end laser emission part in accordance with the distance between the array head 44 upstream in the conveyance direction and the array head 44 downstream.

Example 5

Laser emission was carried out with the optical unit 43 changed for the laser emission parts 42*a* with 127-μm pitches with 192 fibers in FIG. 4-1. The beam diameter on the recording target was 135 μm, the pitch width was 127 μm, and the moving speed of the recording target was 2 [m/sec]. The laser power emitted was controlled by controlling the pulse width by emitting laser light with a pulse of 8 kHz with a peak power of 3.5 W. Here, the peak power was set to 3.5 W in order to facilitate evaluation of density unevenness, although the adequate peak power for saturating the density was 5.0 W. Laser light was emitted every 12 laser emission parts in order to eliminate the effect of adjacent laser emission parts 42*a*. Images of 17 lines were recorded, in which the pulse width of the laser emission parts 42*a* at both ends was set to 100% and the pulse width of the other parts was 95%. Then, the density and the line width were evaluated by visual inspection. The line width and the density were equal in 2 lines at both ends and 15 lines at the center.

Comparative Example 2

Images of 17 lines were recorded under the same conditions as in Example 5 except that the pulse width was set to 95% for both ends and the center. The density and the line width were evaluated by visual inspection. Two lines at both ends had a width thinner than 15 lines at the center and had a low density. The results in Example 5 and Comparative Example 2 described above have proven that the effect of the optical lens is effectively corrected by power of laser light.

First Modification

Figures 1, 9:
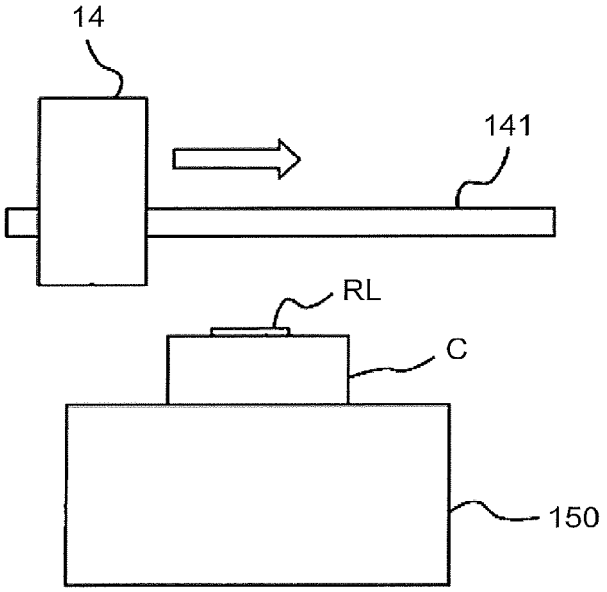
Figures 2, 9:
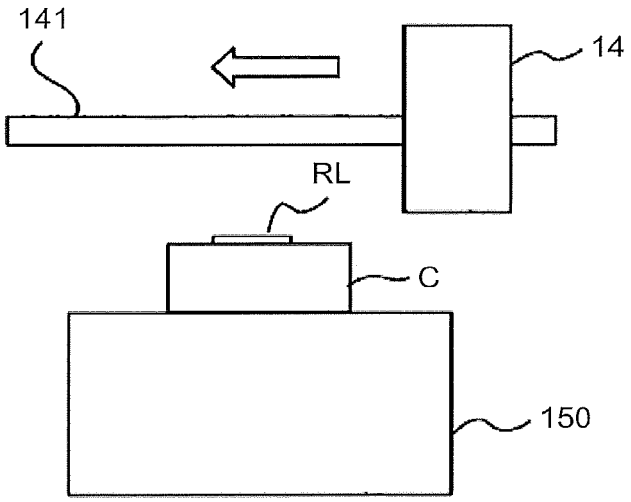

FIG. 9-1 and FIG. 9-2 are diagrams illustrating an example of the image recording system 100 of a first modification.

In this first modification, the recording device 14 moves to record an image on a thermal recording label RL on a container C serving as a recording target.

As illustrated in FIG. 9-1 and FIG. 9-2, the image recording system 100 of this first modification has a platform 150 on which a container C is placed. The recording device 14 is supported on a rail member 141 so as to be movable in the right-left direction in the figure.

In this first modification, first of all, the operator sets a container C on the platform 150 such that a surface having a thermal recording label RL affixed on the container C serving as a recording target faces up. After setting the container C on the platform 150, the operator operates the operation panel 181 to start an image recording process. Upon starting the image recording process, the recording device 14 positioned on the left side in FIG. 9-1 moves to the right side in the figure as indicated by the arrow in FIG. 9-1. The recording device 14 then irradiates the recording target (the thermal recording label RL on the container C) with laser light to record an image while moving to the right side in the figure. After recording an image, the recording device 14 positioned on the right side in FIG. 9-2 moves to the left side as indicated by the arrow in FIG. 9-2 and returns to the position indicated in FIG. 9-1.

In the example described above, the present invention is applied to the recording device 14 that records an image on a thermal recording label RL affixed to a container C. However, the present invention is also applicable, for example, to an image rewriting system that rewrites an image on a reversible thermal recording label affixed to a container C. In this case, an erasing device is provided upstream from the recording device 14 in the conveyance direction of the container C for irradiating a reversible thermal recording label with laser light to erase an image recorded on the reversible thermal recording label. After the erasing device erases an image recorded on the reversible thermal recording label, the recording device 14 records an image. In such an image rewriting system, image density unevenness can also be suppressed.

Although the recording device 14 including a fiber array has been described above, laser light-emitting elements may be arranged in an array, and laser light from the laser light-emitting elements may irradiate a recording target to record an image without passing through optical fibers. Also in such an image rewriting system, a plurality of laser light-emitting element arrays each including 100 to 200 laser light-emitting elements arranged in an array are provided, and the laser light-emitting elements are arranged in a staggered pattern as previously illustrated in FIG. 4-2 or arranged at an angle as illustrated in FIG. 4-3. This is because fabrication of an elongated laser light-emitting element array requires high processing precision and costs much in order to keep linearity of the laser light-emitting element array and the uniformity of pitches of the laser light-emitting elements disposed. Further, a large number of laser light-emitting elements costs much and, disadvantageously, the replacement cost is high when one of the laser light-emitting elements fails. Therefore, providing a plurality of laser light-emitting element arrays each having 100 to 200 laser light-emitting elements arranged in an array can suppress the cost increase of the device and the cost increase for replacement.

The embodiments above have been illustrated only by way of example and achieve effects specific to each of the modes below.

First Mode

An image recording apparatus configured to irradiate a recording target with laser light to record an image includes: a plurality of laser emission parts disposed side by side in a predetermined direction (Z-axis direction) for emitting laser light; an optical system (optical unit 43) configured to collect a plurality of beams of laser light emitted by the laser emission parts onto the recording target moving relative to the laser emission parts in a direction (X-axis direction) crossing the predetermined direction; and an output control unit configured to perform control such that energy of laser light emitted from an outermost end laser emission part that emits laser light to be transmitted through the vicinity of an end portion of the optical system, of the laser emission parts, is greater than energy of laser light emitted from a center laser emission part that emits laser light to be transmitted through a portion other than the vicinity of the end portion of the optical system.

This configuration can make the density of an image recorded by the outermost end laser emission part equal to the density of an image recorded by the center laser emission part.

Second Mode

In the first mode, the image recording apparatus includes a plurality of laser head units (array heads 44) each including the laser emission parts disposed side by side in the predetermined direction. The laser head units are arrayed in the predetermined direction and disposed at positions different from an adjacent laser head unit in the direction crossing the predetermined direction. The output control unit performs control such that energy of laser light emitted from an end laser emission part positioned at an end of the laser head unit, excluding the outermost end laser emission part, is greater than energy of laser light emitted from a laser emission part other than the outermost end laser emission part and the end laser emission part.

As described above, the density of an image recorded by laser light from the end laser emission part not adjacent to a laser emission part on one side is lower than the density of other images. This problem arises for the reason below. Laser light irradiating the recording target affects not only a dot corresponding to the laser light but also a dot adjacent to that dot and increases the temperature of even the adjacent dot. The dot is then heated to a prescribed temperature due to the effect of the laser light corresponding to the dot and the adjacent laser light, and the dot develops a color at a prescribed image density.

However, the laser light emitted from the end laser emission part is adjacent to laser light only on one side. Thus, the dot corresponding to the laser light from the end laser emission part is affected only by the laser light adjacent on one side. As a result, the temperature of the dot fails to increase to the prescribed temperature, and the dot develops a color at an image density lower than a prescribed image density.

Then, in the second mode, control is performed such that energy of laser light emitted from the end laser emission part is greater than the optical energy of laser light emitted from a laser emission part other than the outermost end laser emission part and the end laser emission part. Increasing the optical energy in this manner can increase the temperature of the dot corresponding to laser light emitted from the end laser emission part to a prescribed temperature and enables the dot to develop a color at a prescribed image density. This configuration can make the density of an image recorded by the end laser emission part equal to the density of other images.

The configuration including a plurality of laser head units can suppress elongation of the laser head unit, compared with a configuration including one laser head unit, and can suppress deformation of the laser head unit. Arranging the adjacent laser head units at positions different from each other in the moving direction can improve easiness of assembly of the laser head units.

Third Mode

In the second mode, the output control unit controls energy of laser light emitted from the end laser emission part, in accordance with a relative moving speed of the recording target.

In this configuration, as described in the embodiment, as the conveyance speed increases, the time decreases taken for laser light to be emitted from the laser emission part of the laser head unit downstream in the moving direction (+X-axis direction side) after laser light is emitted from the laser emission part of the laser head unit such as the array head upstream (−X-axis direction) in the moving direction. Thus, as the conveyance speed is higher, the temperature of the corresponding dot can be increased to a prescribed temperature even when the optical energy of laser light emitted from the end laser emission part is lower, and the dot can develop a color at a prescribed image density. This configuration can suppress damage to the recording target due to laser light and can suppress image density unevenness.

Fourth Mode

In the third mode, the image recording apparatus includes a recording target temperature detection unit, such as the first temperature sensor 182, configured to detect temperature of the recording target. The output control unit controls optical energy of laser light emitted from the laser emission part in accordance with a detection result of the recording target temperature detection unit.

In this configuration, as described in the embodiment, as the temperature of the recording target is higher, the temperature of the recording target can be increased to a prescribed temperature with smaller optical energy, thereby developing a color at a prescribed image density. This configuration can suppress damage to the recording target due to laser light and achieve a prescribed image density.

Fifth Mode

In the third mode or the fourth mode, the image recording apparatus includes an environment temperature detection unit, such as the second temperature sensor 183, configured to detect environment temperature. The output control unit controls energy of laser light emitted from the laser emission part, based on a detection result of the environment temperature detection unit.

In this configuration, as described in the embodiment, as the environment temperature is higher, heat by laser light is less likely to escape to the outside, and the temperature of the recording target can be increased to a prescribed temperature with smaller optical energy, thereby developing a color at a prescribed image density. This configuration can suppress damage to the recording target due to laser light and achieve a prescribed image density.

Sixth Mode

In any one of the first mode to the fifth mode, the output control unit controls energy of laser light emitted from the laser emission part based on whether laser light is emitted from another laser emission part adjacent to the laser emission part.

In this configuration, as described in the embodiment, when the adjacent laser emission part does not emit laser light, there is no effect of laser light emitted from the adjacent laser emission part. Thus, the temperature of the recording target may fail to increase to a prescribed temperature. By setting the optical energy of laser light emitted from the laser emission part, based on whether a laser emission part adjacent to that laser emission part emits laser light, the optical energy of laser light can be increased when the adjacent laser emission part does not emit laser light, as described above. A prescribed image density thus can be achieved.

Seventh Mode

In any one of the first mode to the sixth mode, the image recording apparatus includes: a plurality of laser light-emitting elements configured to emit laser light; and a plurality of optical fibers disposed corresponding to the laser light-emitting elements for guiding laser light emitted from the laser light-emitting elements to the recording target. The laser emission part is provided for each of the optical fibers.

In this configuration, as described in the embodiment, it is only necessary to arrange the laser emission parts of the optical fibers such that the pitches in the main scanning direction of image dots formed on the recording target is a prescribed pitch, and there is no need for arranging the laser light-emitting elements such that the pitches in the main scanning direction of the image dots is a prescribed pitch. This configuration enables the arrangement of the laser light-emitting elements such that heat of the laser light-emitting elements can escape and suppresses temperature increase of the laser light-emitting elements. This configuration can suppress variations of the wavelength and the optical output of the laser light-emitting elements.

Eighth Mode

In the seventh mode, energy of laser light emitted from the laser emission part is controlled in accordance with temperature of the laser light-emitting element.

This configuration can correct and suppress variations of output of laser light attributed to the temperature of the laser light-emitting element and enables recording of a satisfactory image on the recording target.

Ninth Mode In the third mode, energy of laser light emitted from the laser emission part positioned at the end is not less than 103% to not more than 150% of energy of laser light emitted from the other laser emission part.

This configuration can suppress density unevenness and suppress damage to the recording target due to laser light emission.

Tenth Mode

In any one of the first mode to the ninth mode, the image recording apparatus includes a recording target conveyance unit, such as the conveyor device 10, configured to convey the recording target. The output control unit allows the laser emission part to emit laser light to record a visible image (image) on the recording target while allowing the recording target conveyance unit to convey the recording target.

This configuration can increase the productivity compared with when the recording target is temporarily stopped and the laser irradiation device such as the recording device 14 is moved to record a visible image on the recording target.

Eleventh Mode

An image recording method is performed in an image recording apparatus configured to irradiate a recording target with laser light to record an image. The image recording apparatus includes: a plurality of laser emission parts disposed side by side in a predetermined direction for emitting the laser light; and an optical system configured to collect a plurality of beams of laser light emitted by the laser emission parts onto the recording target moving relative to the laser emission parts in a direction crossing the predetermined direction. The method includes an output control step of performing control such that energy of laser light emitted from an outermost end laser emission part that emits laser light to be transmitted through the vicinity of an end portion of the optical system, of the laser emission parts, is greater than energy of laser light emitted from a center laser emission part that emits laser light to be transmitted through the vicinity of a center portion of the optical system.

This configuration can make the density of an image recorded by the outermost end laser emission part equal to the density of an image recorded by the center laser emission part.

As clear from the above descriptions, the embodiments can suppress reduction in image density of an image recorded with laser light emitted from the end laser emission part.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

What is claimed is:

1. An image recording apparatus configured to irradiate a recording target with laser light to record an image, comprising:

a plurality of laser emitters that are disposed side by side in a predetermined direction and are configured to emit laser light having energy;

an optical system configured to collect a plurality of beams of laser light emitted by the laser emitters onto the recording target moving relative to the laser emitters in a direction crossing the predetermined direction;

output control circuitry configured to perform control such that the energy of laser light emitted from an outermost end laser emitter of the laser emitters is greater than the energy of laser light emitted from a center laser emitter, the outermost end laser emitter emitting laser light to be transmitted through a vicinity of an end portion of the optical system, the center laser emitter emitting laser light to be transmitted through a portion other than the vicinity of the end portion of the optical system; and a plurality of laser heads each including the laser emitters disposed side by side in the predetermined direction, wherein:

the laser heads are arrayed in the predetermined direction and disposed at positions different from an adjacent laser head in the direction crossing the predetermined direction, and the output control circuitry performs control such that the energy of laser light emitted from an end laser emitter positioned at an end of the laser head, excluding the outermost end laser emitter, is greater than the energy of laser light emitted from a laser emitter other than the outermost end laser emitter and the end laser emitter.

2. The image recording apparatus according to claim 1, wherein the output control circuitry controls the energy of laser light emitted from the end laser emitter, in accordance with a relative moving speed of the recording target.

3. The image recording apparatus according to claim 2, further comprising recording target temperature detection circuitry configured to detect temperature of the recording target, wherein the output control circuitry controls the energy of laser light emitted from the laser emitter in accordance with a detection result of the recording target temperature detection circuitry.

4. The image recording apparatus according to claim 2, further comprising environment temperature detection circuitry configured to detect environment temperature, wherein the output control circuitry controls the energy of laser light emitted from the laser emitter in accordance with a detection result of the environment temperature detection circuitry.

5. The image recording apparatus according to claim 2, wherein the output control circuitry performs control such that the energy of laser light emitted from the laser emitter positioned at the end is not less than 103% to not more than 150% of the energy of laser light emitted from the other laser emitter.

6. The image recording apparatus according to claim 1, comprising:

a plurality of laser light-emitting elements configured to emit laser light; and a plurality of optical fibers disposed corresponding to the laser light-emitting elements for guiding laser light emitted from the laser light-emitting elements to the recording target, wherein the laser emitter is provided for each of the optical fibers.

7. The image recording apparatus according to claim 6, wherein the output control circuitry controls the energy of laser light emitted from the laser emitter in accordance with a temperature of the laser light-emitting element.

8. The image recording apparatus according to claim 1, further comprising a recording target conveyance system configured to convey the recording target, wherein the output control circuitry allows the laser emitter to emit laser light to record an image on the recording target while allowing the recording target conveyance system to convey the recording target.

9. An image recording apparatus configured to irradiate a recording target with laser light to record an image, comprising:

a plurality of laser emitters that are disposed side by side in a predetermined direction and are configured to emit laser light having energy;

an optical system configured to collect a plurality of beams of laser light emitted by the laser emitters onto the recording target moving relative to the laser emitters in a direction crossing the predetermined direction; and output control circuitry configured to perform control such that the energy of laser light emitted from an outermost end laser emitter of the laser emitters is greater than the energy of laser light emitted from a center laser emitter, the outermost end laser emitter emitting laser light to be transmitted through a vicinity of an end portion of the optical system, the center laser emitter emitting laser light to be transmitted through a portion other than the vicinity of the end portion of the optical system, wherein the output control circuitry controls the energy of laser light emitted from the laser emitter, based on whether laser light is emitted from another laser emitter adjacent to the laser emitter.

10. The image recording apparatus according to claim 9, wherein:

the output control circuitry controls the energy of laser light emitted from the end laser emitter, in accordance with a relative moving speed of the recording target.

11. The image recording apparatus according to claim 10, further comprising:

recording target temperature detection circuitry configured to detect temperature of the recording target, wherein the output control circuitry controls the energy of laser light emitted from the laser emitter in accordance with a detection result of the recording target temperature detection circuitry.

12. The image recording apparatus according to claim 10, further comprising:

environment temperature detection circuitry configured to detect environment temperature, wherein the output control circuitry controls the energy of laser light emitted from the laser emitter in accordance with a detection result of the environment temperature detection circuitry.

13. An image recording method performed in an image recording apparatus configured to irradiate a recording target with laser light having energy to record an image, the image recording apparatus comprising:

a plurality of laser emitters that are disposed side by side in a predetermined direction and are configured to emit the laser light;

an optical system configured to collect a plurality of beams of laser light emitted by the laser emitters onto the recording target moving relative to the laser emitters in a direction crossing the predetermined direction; and the method comprising performing control such that energy of laser light emitted from an outermost end laser emitter of the laser emitters is greater than the energy of laser light emitted from a center laser emitter, the outermost end laser emitter emitting laser light to be transmitted through a vicinity of an end portion of the optical system, the center laser emitter emitting laser light to be transmitted through a portion other than the vicinity of the end portion of the optical system, wherein the performing control controls the energy of laser light emitted from the laser emitter, based on whether laser light is emitted from another laser emitter adjacent to the laser emitter.

14. The method according to claim 13, wherein the performing control controls the energy of laser light emitted from the end laser emitter, in accordance with a relative moving speed of the recording target.

15. The method according to claim 14, further comprising:

detecting a temperature of the recording target, wherein the performing control controls the energy of laser light emitted from the laser emitter in accordance with the temperature which has been detected.

16. The method according to claim 14, further comprising:

detecting an environment temperature, wherein the performing control controls the energy of laser light emitted from the laser emitter in accordance with the environmental temperature which has been detected.

17. The method according to claim 14, wherein:

the performing control controls such that the energy of laser light emitted from the laser emitter positioned at the end is not less than 103% to not more than 150% of the energy of laser light emitted from the other laser emitter.

18. The method according to claim 13, wherein:

a plurality of laser light-emitting elements are configured to emit laser light, a plurality of optical fibers are disposed corresponding to the laser light-emitting elements for guiding laser light emitted from the laser light-emitting elements to the recording target, and the laser emitter is provided for each of the optical fibers.

19. The method according to claim 18, wherein:

the performing control controls the energy of laser light emitted from the laser emitter in accordance with a temperature of the laser light-emitting element.

20. The method according to claim 13, wherein:

the performing control controls the laser emitter to emit laser light to record an image on the recording target while instructing a recording target conveyance system to convey the recording target.

* * * * *